US007760159B2

(12) United States Patent
Watanabe et al.

(10) Patent No.: US 7,760,159 B2
(45) Date of Patent: Jul. 20, 2010

(54) APPARATUS AND METHOD FOR DRIVING PLASMA DISPLAY PANEL

(75) Inventors: Takuya Watanabe, Tokyo (JP); Seong Ho Kang, Deagu (KR); Sang Jin Yoon, Geongsangbuk-do (KR); Soo Seok Sim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 1425 days.

(21) Appl. No.: 11/155,670

(22) Filed: Jun. 20, 2005

(65) Prior Publication Data

US 2006/0012544 A1 Jan. 19, 2006

(30) Foreign Application Priority Data

Jul. 19, 2004 (KR) ..... 10-2004-0056123

(51) Int. Cl.
*G09G 3/28* (2006.01)

(52) U.S. Cl. ..... 345/60; 345/67; 315/169.1

(58) Field of Classification Search ..... 345/60–68; 315/169.1–169.4

See application file for complete search history.

(56) References Cited

U.S. PATENT DOCUMENTS

| | | | | |
|---|---|---|---|---|
| 4,550,274 | A * | 10/1985 | Weber | 315/169.4 |
| 6,628,087 | B2 * | 9/2003 | Roh et al. | 315/169.3 |
| 6,636,187 | B2 * | 10/2003 | Tajima et al. | 345/55 |
| 6,806,655 | B2 * | 10/2004 | Choi | 315/169.3 |
| 7,167,146 | B2 * | 1/2007 | Kang | 345/68 |
| 2001/0040536 | A1 | 11/2001 | Masaya et al. | |
| 2002/0089472 | A1 * | 7/2002 | Tsai | 345/60 |
| 2003/0322259 | | 12/2003 | Chung-Kung et al. | |
| 2005/0184929 | A1 | 8/2005 | Lee | |

FOREIGN PATENT DOCUMENTS

| | | |
|---|---|---|
| JP | 10-149135 A | 6/1998 |
| JP | 2000-163001 | 6/2000 |
| KR | 10-2004-0011123 | 2/2004 |
| KR | 10-2005-0082626 | 8/2005 |
| TW | 481856 | 4/2002 |
| TW | 583620 | 4/2004 |
| WO | WO 01/82284 A1 | 1/2001 |

OTHER PUBLICATIONS

Article: "Design and Implementation of PDP Driving System Based on Irregular Addressing Scheme"; Authors: S. Kim, I. Son, D. Myoung; SID International Symposium—published 1998.

* cited by examiner

*Primary Examiner*—Kimnhung Nguyen
(74) *Attorney, Agent, or Firm*—McKenna Long & Aldridge LLP

(57) ABSTRACT

The present invention relates to an apparatus and method for driving a plasma display panel, and more particularly, to a scan drive apparatus and method of a plasma display panel. The present invention includes a data conversion unit converting video data to converted video data suitable for the PDP, a subfield mapping unit mapping a subfield corresponding to the converted video data, a data comparison unit computing a size of a displacement current by comparing video data of a cell bundle including at least one cell situated on a specific scan line to video data of a cell bundle situated in vertical and horizontal directions of the cell bundle according to each scan type of a plurality of scan types, and a scan sequence decision unit deciding a scan sequence according to the scan type having a small displacement current inputted from the data comparison unit.

31 Claims, 17 Drawing Sheets

| | | SF1 | SF2 | SF3 | SF4 | SF5 | SF6 | SF7 | SF8 | SF9 | SF10 | SF11 | SF12 | SF13 | Total weight of selected subfield | Subfield variation count |
|---|---|---|---|---|---|---|---|---|---|---|---|---|---|---|---|---|
| Weight | | 3 | 4 | 7 | 9 | 11 | 2 | 1 | 2 | 3 | 4 | 7 | 9 | 11 | | |
| Gray level | 26 | 1 | 1 | 0 | 0 | 0 | 1 | 0 | 1 | 1 | 1 | 0 | 0 | 0 | 18 | 2 |
| | 27 | 1 | 1 | 0 | 0 | 0 | 1 | 1 | 1 | 1 | 1 | 0 | 0 | 0 | 19 | 1 |
| | 28 | 1 | 0 | 1 | 0 | 0 | 0 | 0 | 0 | 1 | 0 | 1 | 0 | 0 | 20 | 7 |
| | 29 | 1 | 0 | 1 | 0 | 0 | 0 | 1 | 0 | 1 | 0 | 1 | 0 | 0 | 21 | 1 |

Fig. 11

| 1st deoision unit | 2st deoision unit | 3st deoision unit | coefficient |
|---|---|---|---|
| 0 | 0 | 0 | 0 |
| 0 | 0 | 1 | $Cm_2$ |
| 0 | 1 | 0 | $Cm_1+Cm_2$ |
| 0 | 1 | 1 | $Cm_1+Cm_2$ |
| 1 | 0 | 0 | $Cm_1+Cm_2$ |
| 1 | 0 | 1 | $Cm_1+Cm_2$ |
| 1 | 1 | 0 | 0 |
| 1 | 1 | 1 | $4Cm_1+Cm_2$ |

Fig. 13

| Value 1 | Value 2 | Value 3 | coefficient |
|---|---|---|---|
| 0 | 0 | 0 | 0 |
| 0 | 1 | 0 | $Cm_2$ |
| 0 | 0 | 1 | $Cm_1+Cm_2$ |
| 0 | 1 | 1 | $Cm_1+Cm_2$ |
| 1 | 0 | 0 | $Cm_1+Cm_2$ |
| 1 | 1 | 0 | $Cm_1+Cm_2$ |
| 1 | 0 | 1 | 0 |
| 1 | 1 | 1 | $4Cm_1+Cm_2$ |

Fig. 15

| Value 1 or Value 4 or Value 7 | Value 2 or Value 5 or Value 8 | Value 3 or Value 6 or Value 9 | coefficient |
|---|---|---|---|
| 0 | 0 | 0 | 0 |
| 0 | 0 | 1 | $C_{m2}$ |
| 0 | 1 | 0 | $C_{m1}+C_{m2}$ |
| 0 | 1 | 1 | $C_{m1}+C_{m2}$ |
| 1 | 0 | 0 | $C_{m1}+C_{m2}$ |
| 1 | 0 | 1 | $C_{m1}+C_{m2}$ |
| 1 | 1 | 0 | 0 |
| 1 | 1 | 1 | $4C_{m1}+C_{m2}$ |

APPARATUS AND METHOD FOR DRIVING PLASMA DISPLAY PANEL

APPARATUS AND METHOD FOR DRIVING PLASMA DISPLAY PANEL

This Nonprovisional application claims priority under 35 U.S.C. §119(a) to patent application Ser. No. 10-2004-0056123 filed in Korea on Jul. 19, 2004, the entire contents of which are hereby incorporated by reference.

BACKGROUND OF THE INVENTION

1. Field of the Invention

The present invention relates to an apparatus and method for driving a plasma display panel, and more particularly, to a scan drive apparatus and method for a plasma display panel.

2. Description of the Background Art

Generally, a plasma display panel (hereinafter abbreviated PDP) displays an image including characters and graphics by exciting a fluorescent substance using a 147 nm UV-ray emitted as a result of a mixed gas discharge involving (He+Xe) or (Ne+Xe).

FIG. 1 is a perspective diagram of a PDP according to the related art. Referring to FIG. 1, the PDP consists of a Y-electrode 12A and a Z-electrode 12B formed on an upper substrate 10 and an X-electrode 20 formed on a lower substrate 18.

Each of the Y- and X-electrodes 12A and 12B includes a transparent electrode and a bus electrode. The transparent electrode is generally made of indium tin oxide (ITO), whereas the bus electrode is made of metal to reduce resistance thereof.

The PDP includes an upper dielectric layer 14 and a protecting layer 16. The upper dielectric layer 14 and the protecting layer 16 are sequentially stacked on the upper substrate 10 including the Y- and Z-electrodes 12A and 12B.

Wall charges generated as a result of plasma discharge accumulate on the upper dielectric layer 14. The protecting layer 16 protects the upper dielectric layer 14 against sputtering caused by plasma discharge and increases the discharge efficiency of secondary electrons. The protecting layer 16 is generally made of MgO.

The PDP also includes a lower dielectric layer 22 and a barrier rib 24. The lower dielectric layer 22 and the barrier rib 24 are formed on the lower substrate 18, where the X-electrode 20 is formed thereon. A fluorescent layer 26 is formed on the surfaces of the lower dielectric layer 22 and the barrier rib 24.

The X-electrode 20 runs in a direction such that it crosses the Y- and Z-electrodes 12A and 12B. The barrier rib 24 is formed parallel to the X-electrode 20 to prevent UV and visible rays, which are generated as a result of electric discharge, from leaking into neighboring discharge cells.

The fluorescent layer 26 is excited by the UV-rays. The fluorescent layer 26, in turn, emits light including one of red, green, and blue visible light rays. A mixed inert gas such as He+Xe, Ne+Xe, He+Ne+Xe, and the like for purposes of electric discharge, is injected into a discharge space of the discharge cell between the barrier ribs 24 and the upper and lower substrates 10 and 18.

FIG. 2 is a circuit diagram of a drive device in a PDP according to the related art. Referring to FIG. 2, if a channel corresponding to a first Y-electrode Y1 is selected during a scan process, other channels corresponding to the remaining Y-electrodes Y2 to Yn are not selected. Thus, once a channel is selected, for example, scan electrode Y1, a second switching device 213-1 of a first scan driver 210-1 is turned on and a scan switching device 220 is turned on. It will be understood that "on" refers to a switching state where the corresponding switch is closed (i.e., conducting), whereas "OFF" refers to a switching state where the corresponding switch is open (i.e., not conducting). Simultaneously, first switching devices 211-2 to **211-*n* of scan drivers 210-2 to 210-*n* corresponding to the unselected channels and a ground switching device 230** are turned on.

If the first Y-electrode Y1 is selected and a data voltage +Vd is applied to one or more of the X-electrodes X1 to Xm by operation of one or more of the first data switching devices 310-1 to **310-*m* in data driver IC 300-1 to 300-*m*, a write operation is performed on the corresponding cells situated along the first Y-electrode Y1. A data voltage 0V is applied by operation of one or more of the second data switching devices 320-1 to 320-*n*, to each of the remaining X-electrodes for which no write operation will be performed on the corresponding cells along the first Y-electrode Y1**.

Once the above-process is performed for each of the Y-electrodes Y1 to Yn, the scan process is complete. After the scan process, a first sustain switch device 240, second switching devices 213-1 to **213-*n* of scan drivers 210-1 to 210-*n* and a ground switching device 260 are turned on. Accordingly, a first sustain voltage (+Vsy), the first sustain switching device 240, the second switching devices 213-1 to 213-*n* of the scan drivers 210-1 to 210-*n*, the Y-electrodes Y1 to Yn, Z-electrodes Z1 to Zn, and the ground switching device 260 establish a circuit loop such that the first sustain voltage (+Vsy) is applied to all the Y-electrodes Y1** to Yn.

Subsequently, a second sustain switching device 250, the first switching devices 211-1 to **211-*n* of the scan drivers 210-1 to 210-*n*, and the ground switching device 230 are turned on. Accordingly, a second sustain voltage (+Vsz), the Z-electrodes Z1 to Zn, the Y-electrodes Y1 to Yn, the first switching devices 211-1 to 211-*n* of the scan drivers 210-1 to 210-*n*, and the ground switching device 230 establish a circuit loop such that the second sustain voltage (+Vsz) is applied to the Z-electrodes Z1** to Zn.

The drive device of the PDP applies a scan voltage (−Vyscan) and the data voltage (+Vd or 0V) to the corresponding electrodes by the switching operations of the switching devices included in the scan drivers 210-1 to **210-*n* and the data driver IC 300-1 to 300-*m* during a scan period. During this process, a displacement current Id flows in the data driver IC 300-1 to 300-*m*** via the X-electrodes.

As a typical PDP has a 3-electrode configuration, a first equivalent capacitor Cm1 is situated between X-electrodes and a second equivalent capacitor Cm2 is situated between the X- and Y-electrodes and/or between the X- and Z-electrodes, which is shown in FIG. 2.

Since the state of the voltage applied to the electrodes changes according to the operation of the switching devices included in the scan drivers 210-1 to **210-*n* and the data driver ICs 300-1 to 300-*m*, the displacement current generated by the first and second equivalent capacitors Cm1 and Cm2 flows into the data driver IC 300-1 to 300-*m*** via the X-electrodes.

Yet, the displacement current Id flowing into the data driver IC 300-1 to **300-*m* and the corresponding power vary depending on the video data applied to the X-electrodes X1** to Xm.

FIGS. 3A to 3E are diagrams illustrating displacement current and corresponding power according to video data. Referring to FIG. 2 and FIG. 3A, when the second Y-electrode Y2 is scanned, video data having alternating logic values 1 and 0 are applied to the X-electrodes X1 to Xm. When the third Y-electrode Y3 is scanned, a logic value 0 is sustained at the X-electrodes X1 to Xm. The logic value 1 means that the data voltage +Vd is applied to the corresponding X-electrode, and the logic value 0 means that 0V is applied to the corresponding X-electrode.

More generally, video data having alternating logic values 1 and 0 is applied to a given cell on a Y-electrode (e.g., the second Y-electrode Y2), while video data having the logic value 0 is applied to an adjacent cell on the next Y-electrode (e.g., Y-electrode Y3). In doing so, the displacement current Id flowing into each of the X-electrodes and the corresponding power Pd follow Formula 1.

$$Id=\tfrac{1}{2}(Cm1+Cm2)^{-1}*V_A \quad \text{[Formula 1]}$$

$$Pd=\tfrac{1}{2}(Cm1+Cm2)^{-1}*V_A^2$$

Id: displacement current flowing in each X-electrode

Cm1: $1^{st}$ equivalent capacitor

Cm2: $2^{nd}$ equivalent capacitor

Va: voltage applied to each X-electrode (+Vd or 0V)

Pd: power consumption due to displacement current Id

Referring to FIG. 2 and FIG. 3B, when the second Y-electrode Y2 is scanned, video data sustaining the logic value 1 is applied to the X-electrodes X1 to Xm. When the third Y-electrode Y3 is scanned, a logic value 0 is sustained at the X-electrodes X1 to Xm. The logic value 0 means that 0V are applied to the corresponding X-electrode.

More generally, video data having the logic value 1 is applied to a given cell on a Y-electrode (e.g., the second Y-electrode Y2), while video data having the logic value 0 is applied to an adjacent cell on the next Y-electrode (e.g., the third Y-electrode Y3). Alternatively, video data having the logic value 0 is applied to a give cell on a Y-electrode (e.g., the second Y-electrode Y2), while video data having the logic value 1 is applied to an adjacent cell on a next Y-electrode (e.g., the third Y-electrode Y3). In doing so, the displacement current Id flowing into each of the X-electrodes and the corresponding power follow Formula 2.

$$Id=\tfrac{1}{2}(Cm2)^{-1}*V_A \quad \text{[Formula 2]}$$

$$Pd=\tfrac{1}{2}(Cm2)^{-1}*V_A^2$$

Id: displacement current flowing in each X-electrode.

Cm2: $2^{nd}$ equivalent capacitor

Va: voltage (0V) applied to each X-electrode (+Vd or 0V)

Pd: power consumption due to displacement current Id

Referring to FIG. 2 and FIG. 3C, when the second Y-electrode Y2 is scanned, video data having alternating logic values 1 and 0 is applied to the X-electrodes X1 to Xm. When the third Y-electrode Y3 is scanned, video data having alternating logic values 1 and 0, which is 180° out of phase with the video data applied to the cell on the second Y-electrode Y2, is applied. The logic value 1 means that the data voltage (+Vd) is applied to the corresponding X-electrode, and the logic value 0 means that 0V is applied to the corresponding X-electrode.

More generally, video data having the alternating logic values 1 and 0 is applied to a given cell on an Y-electrode (e.g., Y2), while video data having alternating logic values 1 and 0, which is 180° out of phase with the video data applied to the cell on the aforementioned electrode, is applied to an adjacent cell on the next Y-electrode (i.e., Y3). In doing so, the displacement current Id flowing into each of the X-electrodes and the corresponding power follow Formula 3.

$$Id=\tfrac{1}{2}(4Cm1+Cm2)^{-1}*V_A \quad \text{[Formula 3]}$$

$$Pd=\tfrac{1}{2}(4Cm1+Cm2)^{-1}*V_A^2$$

Id: displacement current flowing in each X-electrode

Cm1: $1^{st}$ equivalent capacitor

Cm2: $2^{nd}$ equivalent capacitor

Va: voltage applied to each X-electrode (+Vd or 0V)

Pd: power consumption due to displacement current Id

Referring to FIG. 2 and FIG. 3D, when the second Y-electrode Y2 is scanned, video data having alternating logic values 1 and 0 is applied to the X-electrodes X1 to Xm. When the third Y-electrode Y3 is scanned, video data having alternating logic values, which has the same phase as (i.e., in phase with) the video data applied to the cell on the second Y-electrode Y2, is applied. The logic value 1 means that the data voltage (+Vd) is applied to the corresponding X-electrode, and the logic value 0 means that 0V is applied to the corresponding X-electrode.

More generally, video data having the alternating logic values 1 and 0 is applied to a given cell on one Y-electrode (e.g., Y2), while video data having alternating logic values 1 and 0, which has the same phase as the video data applied to the cell on the aforementioned electrode is applied to an adjacent cell on the next Y-electrode (e.g., Y3). In doing so, the displacement current Id flowing into each of the X-electrodes and the corresponding power follow Formula 4.

$$Id=0 \quad \text{[Formula 4]}$$

$$Pd=0$$

Id: displacement current flowing in each X-electrode

Pd: power consumption due to displacement current Id

Referring to FIG. 2 and FIG. 3E, when the second Y-electrode Y2 is scanned, video data sustaining a logic value 0 is applied to the X-electrodes X1 to Xm. When the third Y-electrode Y3 is scanned, video data sustaining a logic value 0 is applied to the third Y-electrode Y3. The logic value 0 means that 0V are applied to the corresponding X-electrode. More generally, video data sustaining the logic value 0 is applied to a given cell on one Y-electrode (e.g., Y2), while video data sustaining the logic value 0 is applied to an adjacent cell on the next Y-electrode (e.g., Y3). Alternatively, video data sustaining the logic value 1 is applied to a given cell on one Y-electrode (e.g., Y2), while video data sustaining the logic value 1 is applied to an adjacent cell on a next Y-electrode (e.g., Y3). In doing so, the displacement current Id flowing in each of the X-electrodes and the corresponding power follow Formula 5.

$$Id=0 \quad \text{[Formula 5]}$$

$$Pd=0$$

Id: displacement current flowing in each X-electrode

Pd: power consumption due to displacement current Id

As shown by Formula 1 through Formula 5, the greatest amount of displacement current Id flowing into the X-electrodes occurs when video data having alternating logic values 1 and 0 is applied to the cell on a first Y-electrode and video data having alternating logic values 1 and 0, which is 180° out of phase with the video data applied to the cell on the first Y-electrode, is applied to an adjacent cell on a next Y-electrode.

In contrast, the least amount of displacement current Id flowing into the X-electrodes occurs when video data having alternating logic values 1 and 0 is applied to the cell on a first Y-electrode and video data having alternating logic values 1 and 0, which has the same phase as the video data applied to the cell on the first Y-electrode, is applied to the next Y-electrode. A least amount of displacement current Id also occurs when video data sustaining the logic value 0 is applied to both the cell on the first Y-electrode and the cell on the next Y-electrode.

Thus, the image displayed on the PDP according to the video data shown in FIGS. 3A to 3E corresponds to one of FIGS. 4A through 4D. Accordingly, the grid type image shown in FIG. 4C corresponds with the greatest amount of displacement current Id. Again, if the same video data is applied to the X-electrode, the smallest amount of displacement current occurs.

With respect to the data driver IC associated with one X-electrode, the video data in FIG. 3C and FIG. to the case where the number of switching operations of the data driver IC (i.e., the switching count) is the highest. Hence, the higher the switching count, the greater the displacement current Id flowing into the data driver IC.

Conversely, the video data in FIG. 3D, 3E and FIG. 4D correspond to the case where the switching count of the data driver IC is the smallest. Hence, the lower the switching count, the smaller the displacement current Id flowing into the data driver IC.

Again, maximum displacement current flows into the X-electrode when the PDP displays the grid type image thereon, as shown in FIG. 4C. However, the maximum displacement current Id can cause damage to the data driver ICs 300-1 to **300-*m***. The grid type image is used in half-toning to improve the image quality of the PDP, but in doing so, it brings about more serious problems.

FIG. 5A and FIG. 5B are diagrams for explaining dithering which is used to improve image quality in a conventional PDP. FIG. 5A illustrates a number of 4×4 dithering masks used for producing a ⅛ gray level through a ⅞ gray level. The use of a dithering process is for image quality enhancement in a PDP. These masks include a ⅝ gray level mask which exhibits the grid type pattern corresponding to FIG. 3C and FIG. 4C. Hence, the dither mask used in the dithering process induces a maximum displacement current Id.

In case of representing a gray level 27.5 using a dither mask, it is necessary to use subfields SF1, SF2, SF6, SF7, SF8, SF9, and SF10 for representing a gray level 27, and subfields SF1, SF3, SF9, and SF11 for representing a gray level 28, as shown in FIG. 5B, among subfields SF1 through SF13 to which corresponding weights are allocated, respectively. Thus, subfields SF2, SF6, SF7, SF8, and SF10 are selected in representing gray level 27, but not selected in representing gray level 28. On the other hand, subfields SF3 and SF11 are not selected in representing gray level 27, but are selected in representing gray level 28. As one can see, transitioning from gray level 27 to gray level 28 involves changing subfields takes place seven times. Changing subfield abruptly increments the switching count of the data driver IC. This, together with the grid type dither mask corresponding to the ⅝ gray level, causes a considerably high amount of displacement current Id to flow into the data driver IC. The considerably high amount of displacement current Id may cause the data drive IC to fail or to abnormally operate.

SUMMARY OF THE INVENTION

Accordingly, an object of the present invention is to solve at least the problems and disadvantages associated with the background art.

Another object of the present invention is to provide a scan drive apparatus and method for a plasma display panel, by which the size of the displacement current associated with a pattern of specific video data, and more particularly, to video data used in a dithering process, is minimized.

In accordance with the various embodiments of the present invention, the above-identified and other objects are achieved through an plasma display apparatus and/or method of driving a plasma display apparatus that involves identifying one scan type from amongst a plurality of scan types based on the displacement currents corresponding to each of the plurality of scan types, scanning each of a plurality of scan electrodes according to a scanning pattern that corresponds with the one identified scan type, and applying data signals to each of a plurality of address electrodes in accordance with the scanning pattern corresponding to the one identified scan type.

BRIEF DESCRIPTION OF THE DRAWINGS

The invention will be described in detail with reference to the following drawings in which like numerals refer to like elements.

FIG. 11 is a table of pattern contents of video data according to output signals of first to third decision units included in a basic circuit block of a data comparison unit of the present invention.

FIG. 13 is a table of pattern contents according to output signals of first to third decision units XOR1, XOR2, and XOR3 included in a data comparison unit according to a first embodiment of the present invention.

FIG. 15 is a table of pattern contents according to output signals of first to ninth decision units XOR1 to XOR9 included in a basic circuit block according to a second embodiment of the present invention.

DETAILED DESCRIPTION OF PREFERRED EMBODIMENTS

Preferred embodiments of the present invention will now be described in a more detailed manner with reference to the drawings.

Figure 6:
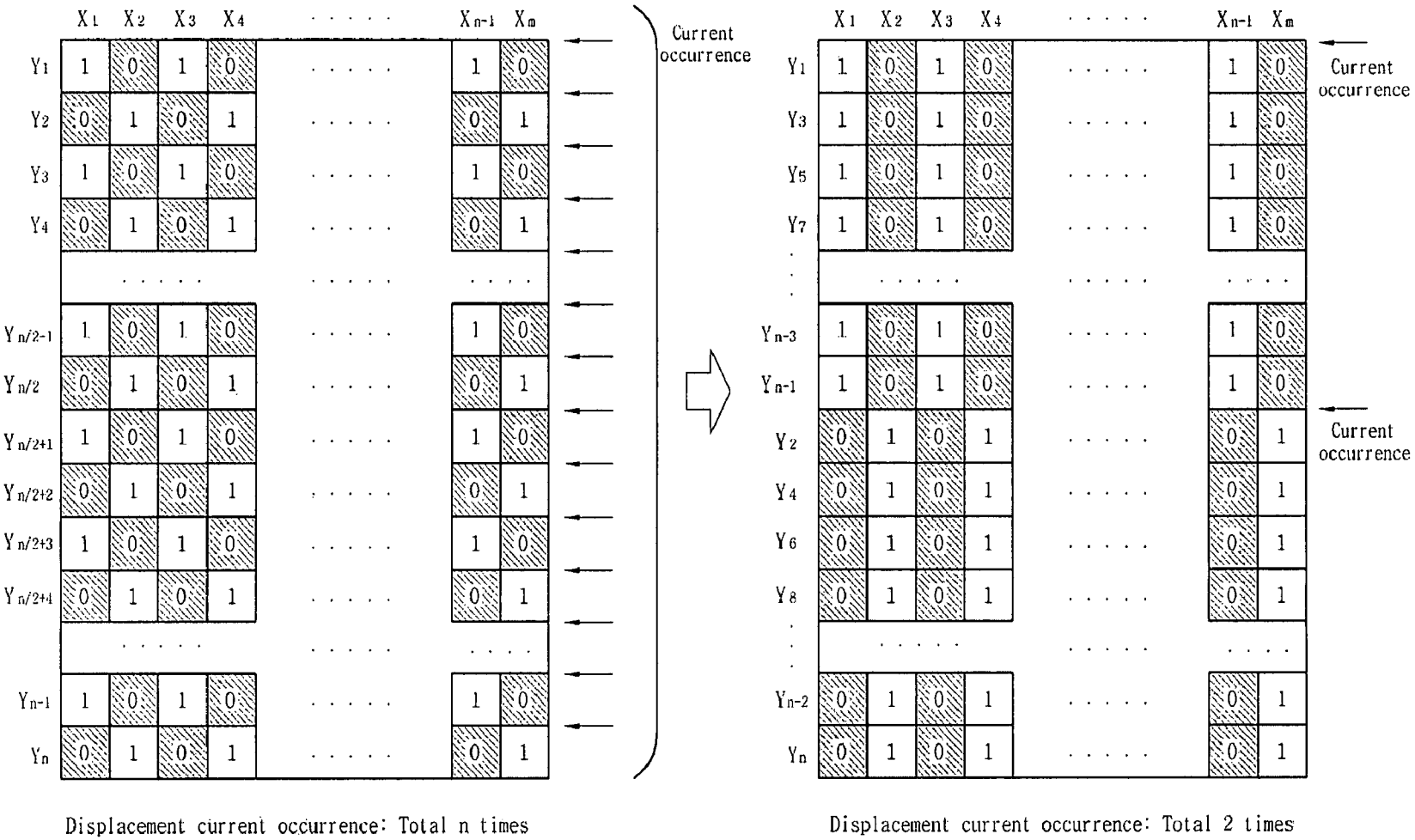
FIG. 6 is a diagram for explaining a concept of a drive method according to the present invention.

FIG. 6 is a diagram illustrating a PDP drive method according to the present invention. As mentioned in the foregoing description, a dither mask corresponding to a 4/8 gray level, among 4×4 dither masks, generates a maximum displacement current potential. More specifically, when data pulses corresponding to a grid pattern are applied to Y-electrodes during scanning a first Y-electrode Y1, displacement currents are generated a total of n times. This is illustrated by the left-most video data pattern in FIG. 6.

In the grid pattern shown in FIG. 6, the phases of video data corresponding to the Y1, Y3, Y5, . . . Yn−1 scan lines are equal to each other, while the phases of video data corresponding to Y2, Y4, Y6, . . . Yn scan lines are equal to each other. However, as shown on the right side of FIG. 6, if video data having the same phase is sequentially applied to the Y1, Y3, Y5, . . . Yn−1 scan lines, and then subsequently, video data having the same phase is sequentially applied to the Y2, Y4, Y6, . . . Yn scan lines, the total number of displacement current occurrences is only. Thus, by first sequentially scanning Y1, Y3, Y5 . . . Yn−1, and then sequentially scanning Y2, Y4, Y6 . . . Yn, it is possible to considerably reduce the number of displacement current occurrences.

Stated differently, a data driver IC switching operation occurs only at the time the video data is first applied to the first group of scan lines and, more specifically, to scan line Y1. No further switching operation occurs until video data is first applied to the second group of scan lines . . . Y2, Y4, Y6, . . . Yn and more specifically, to scan line Y2. Hence, the occurrence of displacement current is substantially minimized.

Figure 7:
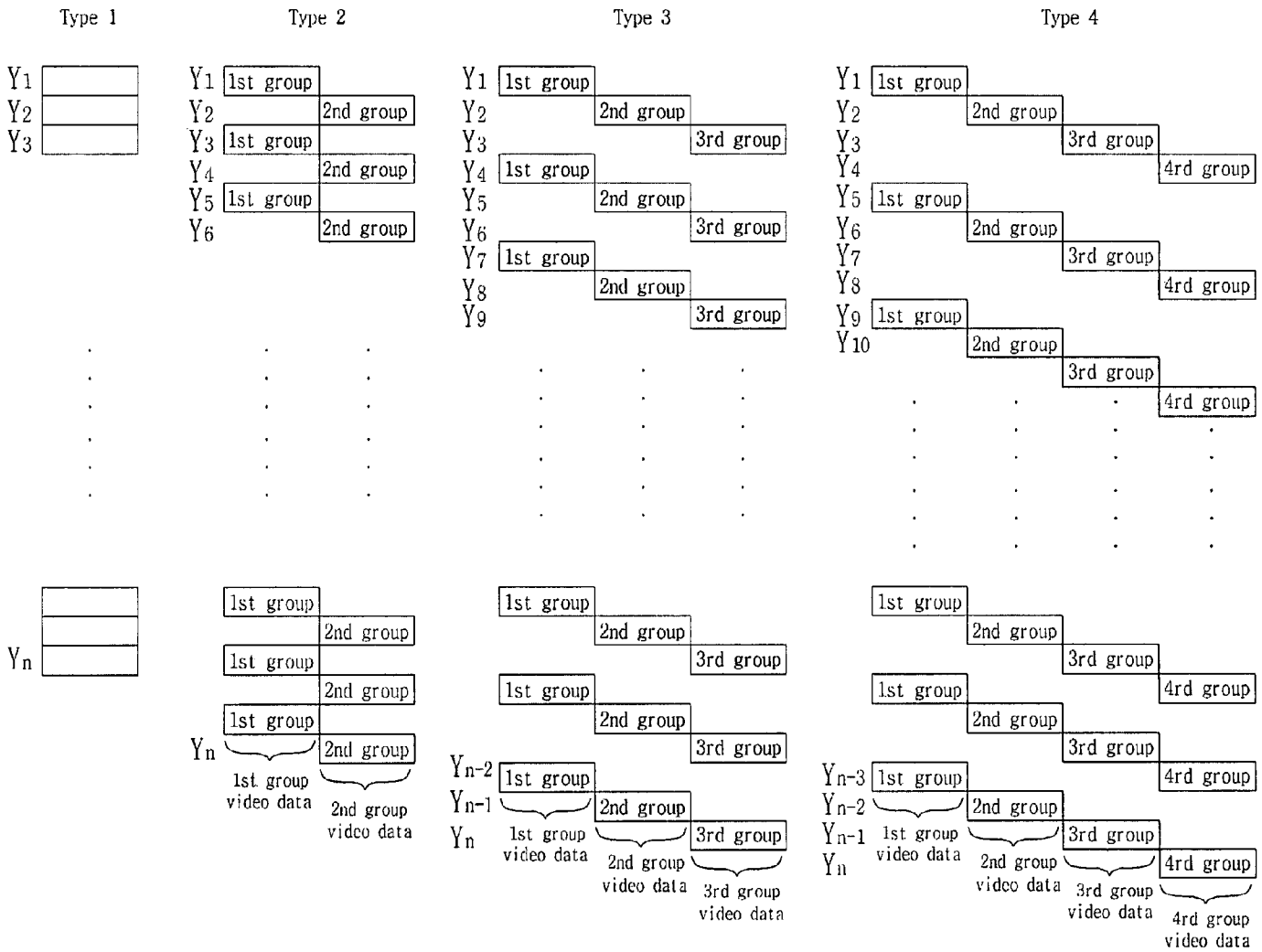
FIG. 7 is a diagram for explaining a drive method of PDP according to the present invention.

FIG. 7 is a diagram illustrating a drive method for a PDP according to the present invention. Referring to FIG. 7, the drive method performs a scan according to scan sequences of four scan types. In a scan sequence of a first scan type, Type 1, the scan is executed according to the sequence Y1-Y2-Y3 . . . Yn.

In a scan sequence of a second scan type, Type 2, Y-electrodes belonging to a first group are sequentially scanned and then Y-electrodes belonging to a second group are sequentially scanned. More specifically, a first scan according to the sequence Y1-Y3-Y5 . . . Yn−1 is performed, followed by a second scan according to the sequence Y2-Y4-Y6 . . . Yn.

In a scan sequence of a third scan type, Type 3, Y-electrodes belonging to a first group are sequentially scanned, Y-electrodes belonging to a second group are then sequentially scanned, and Y-electrodes belonging to a third group are then scanned. More specifically, the first scan sequence may involve Y1-Y4-Y7 . . . Yn−2, the second scan sequence may involve Y2-Y5-Y8 . . . Yn−1, and the third scan sequence may involve Y3-Y6-Y9 . . . Yn.

In a scan sequence of a fourth scan type, Type 4, Y-electrodes belonging to a first group are sequentially scanned, Y-electrodes belonging to a second group are then sequentially scanned, Y-electrodes belonging to a third group are then sequentially scanned, and Y-electrodes belonging to a fourth group are then sequentially scanned. More specifically, the first scan sequence may involve Y1-Y5-Y9 . . . Yn−3, the second scan sequence may involve Y2-Y6-Y10 . . . Yn−2, the third scan sequence may involve Y3-Y7-Y11 . . . Yn−1, and the third scan sequence may involve Y4-Y8-Y12 . . . Yn.

Figure 8:
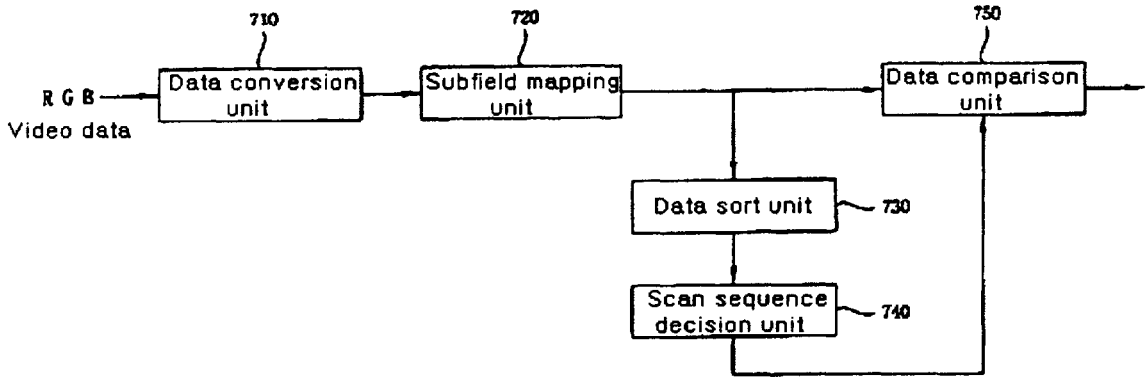
FIG. 8 is a block diagram of a drive apparatus for PDP according to the present invention.

FIG. 8 is a block diagram of a drive apparatus for a PDP according to the present invention. Referring to FIG. 8, the drive apparatus includes a data conversion unit 710, a subfield mapping unit 720, a data comparison unit 730, a scan sequence decision unit 740, and a data sort unit 750.

The data conversion unit 710 receives RGB video data. It then converts the RGB video data to video data that is suitable for the PDP using inverse gamma correction, error diffusion, and dithering.

The subfield mapping unit 720 receives the converted video data from the data conversion unit 710. The subfield mapping unit 720 then performs subfield mapping on the converted video data.

The data comparison unit 730 computes displacement current Id by comparing the video data of a cell bundle having at least one cell situated on a specific scan line to the video data of another cell bundle situated in vertical and horizontal directions relative to the first cell bundle. The data comparison unit 750 computes displacement current Id in this way for each of a plurality of scan types (e.g., the four exemplary scan types 1, 2, 3 and 4).

The term "cell bundle" means one or more cells that are bundled into a unit. For instance, cells corresponding to R, G, and B are bundled to form one pixel. Hence, the pixel, for example, corresponds to a cell bundle.

The scan sequence decision unit 740 receives the displacement current information, for all of the scan types, from the data comparison unit 730. It then determines which scan sequence (i.e., which scan type) is preferable based on which scan sequence results in the smallest number of displacement current occurrences. Alternatively, the scan sequence decision unit 740 determines which scan sequence to use based on whether the displacement current associated with the scan sequence is below a predefined amount (e.g., a predefined threshold value).

The data sort unit 750 re-sorts the video data, to which the subfield is mapped, per subfield. The data sort unit 750 re-sorts the subfield-mapped video data per subfield according to the preferred scan sequence which was selected by the scan sequence decision unit 740. The data Sort Unit 750 then applies the re-sorted video data to X-electrodes accordingly.

In an alternative embodiment, the data comparison unit 730 may instead compare the displacement current Id, for each of the scan type, to a predefined threshold value. The data comparison unit 730 might then choose a scan type whose corresponding displacement current Id is less than the predefined threshold value.

Figure 9:
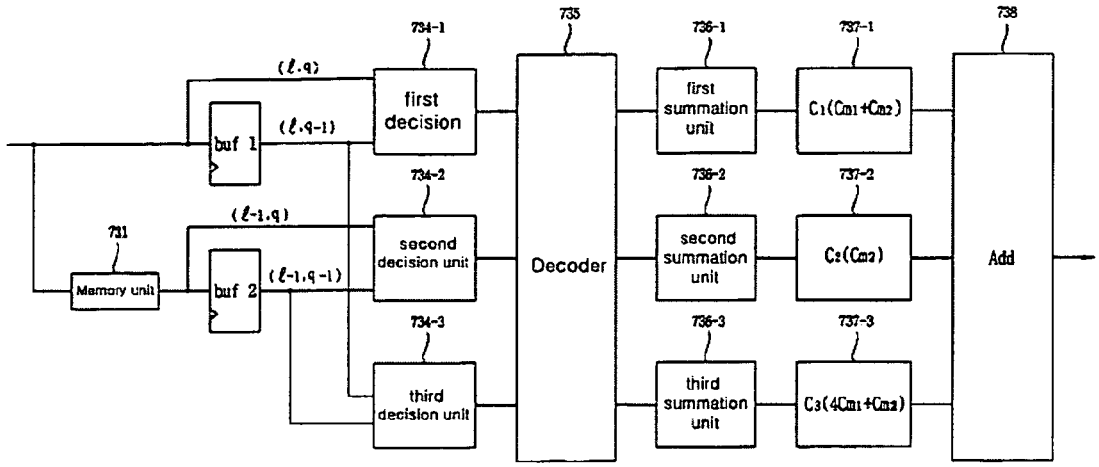
FIG. 9 is a block diagram of a basic circuit block included in a data comparison unit of the present invention.

FIG. 9 is a block diagram of the data comparison unit 730 in accordance with the present invention. Referring to FIG. 9 the data comparison unit 730 includes a memory unit 731, a first buffer buf1, a second buffer buf2, first to third decision units 734-1 to 734-3, a decoder unit 735, first to third summation units 736-1 to 736-3, first to third current calculating unit 737-1 to 737-3, and a current summation unit 738.

Video data corresponding to an (l−1)th Y-electrode, i.e., an (l−1)th scan line is stored in the memory unit 731, and video data corresponding to an lth Y-electrode, i.e., an lth scan line is inputted. The first buffer buf1 temporarily stores video data for the (q−1)th cell among cells corresponding to the lth line. The second buffer buf2 temporarily stores video data for the (q−1)th cell among cells corresponding to the (l−1)th line.

The first decision unit 734-1, which includes an exclusive OR gate, compares video data for the qth cell on the lth line to video data for the (q−1)th cell on the lth line stored in the first buffer buf1. If they are different from each other, the first decision unit 734-1 outputs 1. If they are equal to each other, the first decision unit 734-1 outputs 0.

The second decision unit 734-2, which includes an exclusive OR gate, compares video data for the qth cell on the (l−1)th line to video data for the (q−1)th cell on the (l−1)th line stored in the second buffer buf2. If they are different from each other, the second decision unit 734-2 outputs 1. If they are equal to each other, the second decision unit 734-2 outputs 0.

The third decision unit 734-3, which includes an exclusive OR gate, compares the video data for the (q−1)th cell on the lth line stored in the first buffer buf1 to video data for the (q−1)th cell on the (l−1)th line stored in the second buffer buf2. If they are different from each other, the third decision unit 734-3 outputs 1. If they are equal to each other, the third decision unit 734-3 outputs 0.

Figure 10:
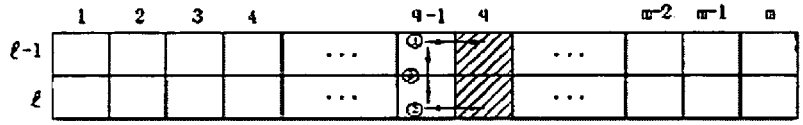
FIG. 10 is a diagram of comparison operations of first to third decision units included in a basic circuit block of a data comparison unit of the present invention.

FIG. 10 is a diagram of comparison operations involving the first through the third decision units 734-1, 734-2 and 734-3, as shown in FIG. 9, of the data comparison unit 730, where operations 1, 2 and 3 correspond to the aforementioned operations of the first decision unit 734-1, the second decision unit 734-2, and the third decision unit 734-3, respectively. More generally, the data comparison unit 730 of the present invention compares the video data of neighboring cells in horizontal and vertical directions using the first, second and third decision units 734-1, 734-2 and 734-3 to determine the video data variation.

The decoder 735 receives the output from each of the exclusive OR gates in each of the three decision units 734-1, 734-2, and 734-3. The decoder 735 then outputs a 3-bit signal corresponding to each output signal from the decision units 734-1, 734-2, and 734-3.

Figure 3:
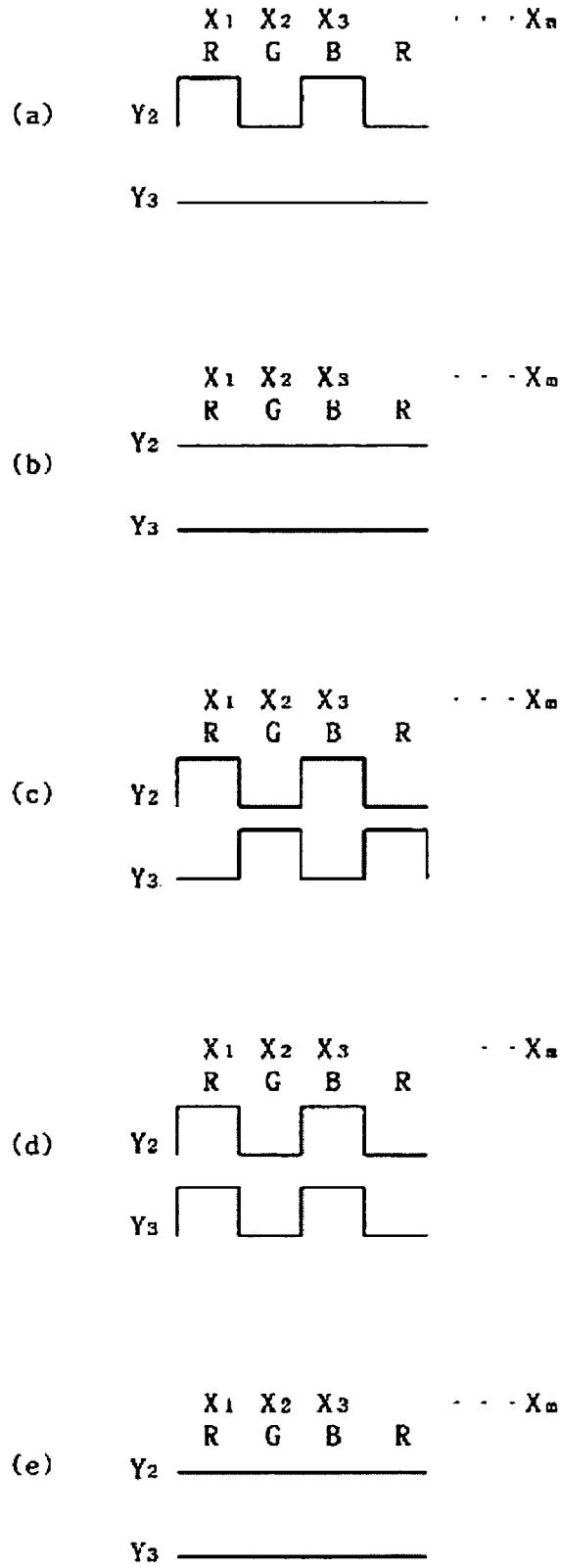
FIGS. 3A to 3E are diagrams of displacement current and corresponding power according to video data.
Figure 4A:
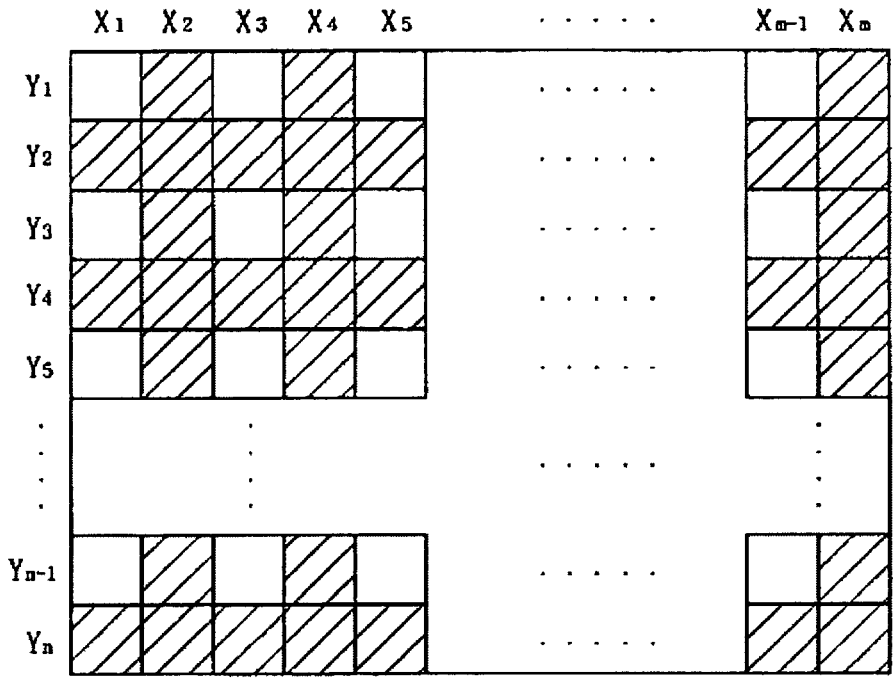
FIGS. 4A to 4D are diagrams of images displayed on PDP according to video data.
Figure 4B:
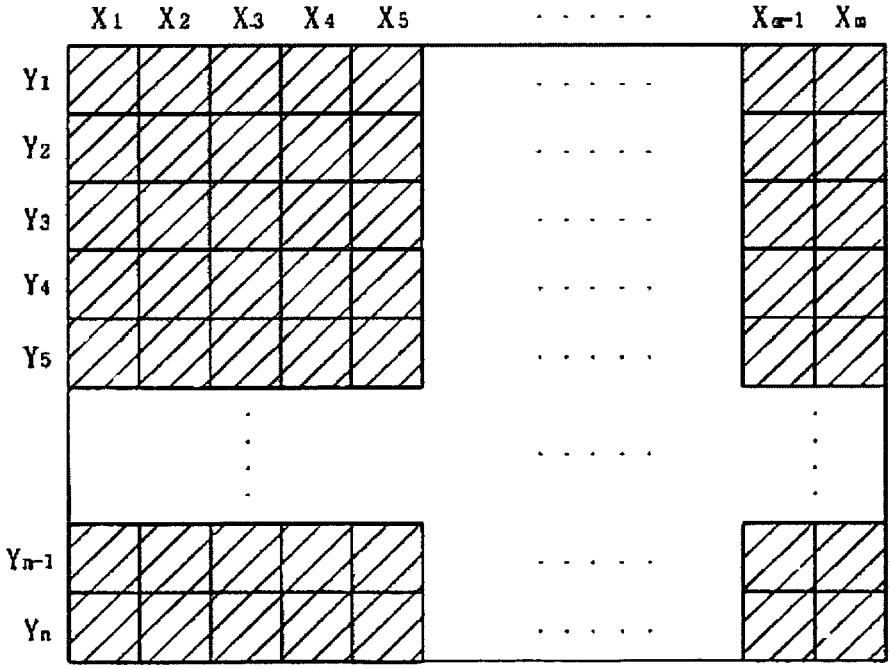
Figure 4C:
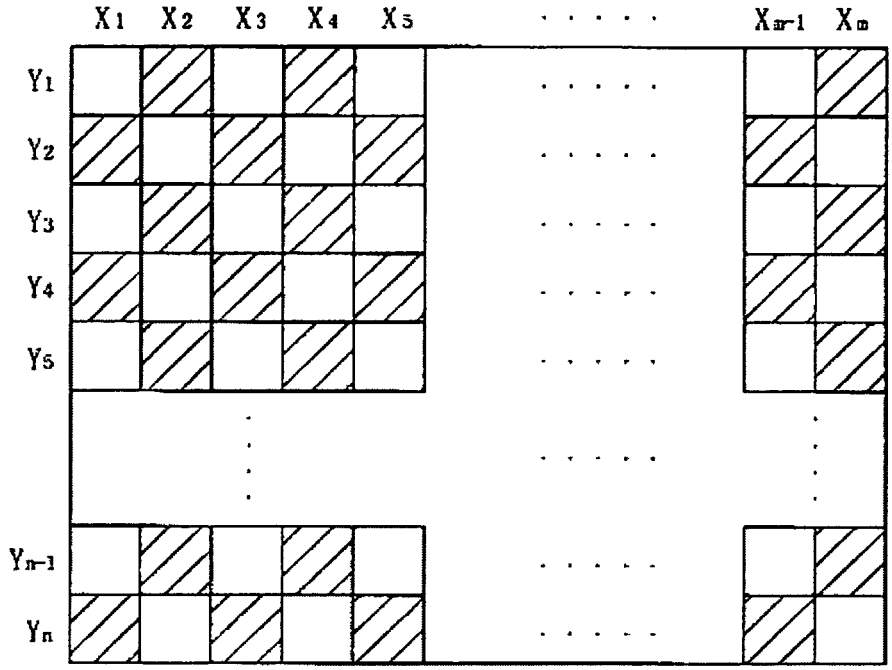
Figure 4D:
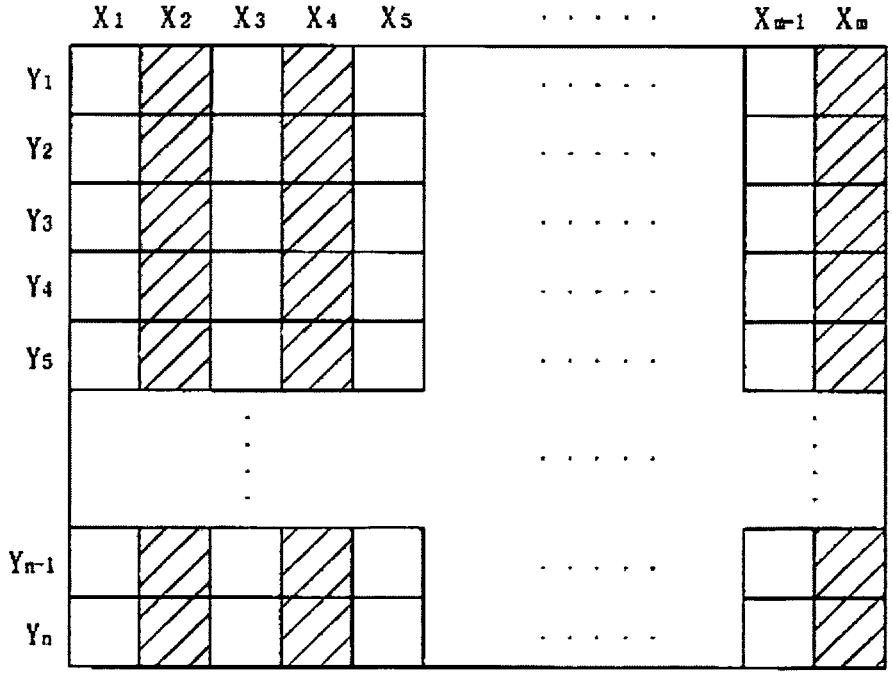
Figures 5A, 5B:
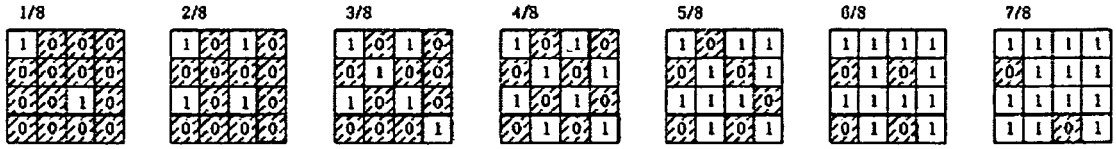
FIG. 5A and FIG. 5B are diagrams for explaining dithering used in improving image quality of a general PDP.

FIG. 11 is a table containing all possible combinations for the 3-bit output signal of the decoder 735. If the output signals of decoder 735 is (0, 0, 0), the state of the video data is as shown in FIG. 3E, where the displacement current Id is 0. If the output signal of decoder 735 is (0, 0, 1), the state of the video data is as shown in FIG. 3B, where the displacement current Id is proportional to Cm2. If the output signal is one of (0, 1, 0), (0, 1, 1), (1, 0, 0), and (1, 0, 1), the state of the video data is as shown in FIG. 3A, where the displacement current Id is proportional to (Cm1+Cm2). If the output signal is (1, 1, 0), the state of the video data is as shown in FIG. 3D, where the displacement current Id is 0. Finally, if the output signal is (1, 1, 1), the state of the video data is as shown in FIG. 3C, where the displacement current Id is proportional to (4Cm1+Cm2).

Referring once again to FIG. 10, each of the first, second and third summation units 736-1, 736-2 and 736-3 sums up an output count of a specific 3-bit output signal from the decoder 735. More specifically, the first summation unit 736-1 sums up a count (C1) for one of (0. 1. 0), (0, 1, 1), (1, 0, 0), and (1, 0, 1) outputted from the decoder 735. The second summation unit 736-2 sums up a count (C2) for (0, 0, 1) outputted from the decoder 735. And, the third summation unit 736-1 sums up a count (C3) for (1, 1, 1) outputted from the decoder 735.

Each of the first, second and third current calculating units 737-1, 737-2 and 737-3 receives C1, C2, and C3, respectively, from the summation units 736-1, 736-2 and to 736-3, and computes a corresponding displacement current. The current summation unit 738 then totals the computed displacement current values provided by the current calculating units 737-1, 737-2 and to 737-3.

Figure 12:
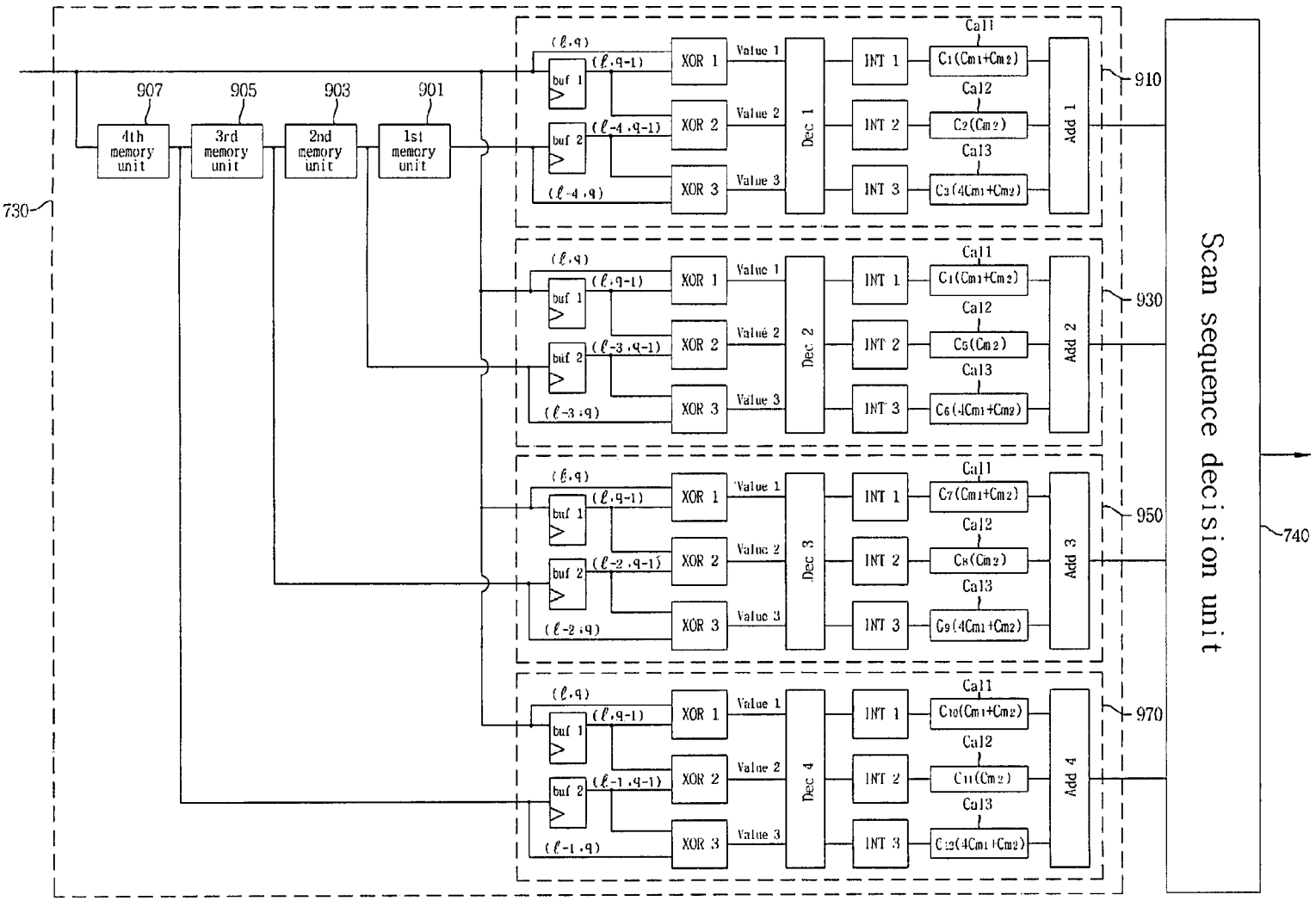
FIG. 12 is a block diagram of a data comparison unit and a scan sequence decision unit according to a first embodiment of the present invention.

FIG. 12 is a block diagram of the data comparison unit 730 and the scan sequence decision unit 740 according to a first embodiment of the present invention. Referring to FIG. 12, the data comparison unit 730, according to the first embodiment of the present invention, has a configuration that includes four of the basic circuits which are shown in detail in FIG. 10. The scan sequence decision unit 740 then compares the outputs from the four basic circuits and based thereon, determines which scan sequence generates the smallest displacement current. Alternatively, the scan sequence decision unit 740 determines which scan sequence to use based on whether the displacement current associated with the scan sequence is below a predefined amount (e.g., a predefined threshold value).

The data comparison unit 730 includes first through fourth memory units 901, 903, 905, and 907, and first through fourth current determination units 910, 930, 950, and 970 as shown in FIG. 12. The memory units 901, 903, 905 and 907 and the current determination units 910, 930, 950 and 970 all operate as described above with reference to the data comparison unit 730 of FIG. 9.

The first to fourth memory units 901, 903, 905, and 907, which are connected in series, store video data corresponding to four scan lines, respectively. For example, the first memory unit 901 stores the video data corresponding to an (l−4)th line, the second memory unit 903 stores the video data corresponding to an (l−3)th line, the third memory unit 905 stores the video data corresponding to an (l−2)th line, and the fourth memory unit 907 stores the video data corresponding to an (l−1)th line.

The first current determination unit 910 receives the video data for the lth line and the video data of the (l−4)th line stored in the first memory unit 901. The second current determination units 930 receives the video data for the lth scan line and the video data for the (l−3)th scan line stored in the second memory unit 903. Likewise, the third and fourth current determination units, 950 and 970, receive the video data for the lth scan line and the (l−2)th and the (l−1)th scan line, respectively. If, for example, the computed current for the first current determination unit 910 is smaller than the computed current for each of the second, third and fourth current determination units 930, 950, and 970, the preferred scan sequence will be the fourth scan type, Type 4, as illustrated in FIG. 7. Specifically, the preferred scan sequence would be as follows: Y1-Y5-Y9 . . . Yn−3, Y2-Y6-Y10 . . . Yn−2, Y3-Y7-Y11 . . . Yn−1, and Y4-Y8-Y12 . . . Yn.

The operation of the first current determination unit 910 is as described above with respect to the configuration shown in FIG. 9. Thus, the video data corresponding to the (l−4)th scan line is stored in the first memory unit 901 and the video data corresponding to the lth line is received directly. The first buffer buf1 temporarily stores the video data for the (q−1)th cell from the lth line, and the second buffer buf2 temporarily stores the video data for the (q−1)th cell from the (l−4)th line.

A first decision unit XOR1, which includes an exclusive OR gate, compares the video data (l,q) of the qth cell on the lth line to the video data (l,q−1) of the (q−1)th cell on the lth line stored in the first buffer buf1. If they are different from each other, the first decision unit XOR1 output value=1. If they are equal to each other, the first decision unit XOR1 output value=0.

A second decision unit XOR2, which includes an exclusive OR gate, compares the video data (l,q−1) of a (q−1)th cell on the lth line to the video data (l−4,q−1) of the (q−1)th cell on the (l−4)th line stored in the second buffer buf2. If they are different from each other, the second decision unit XOR2 output value=1. If they are equal to each other, the second decision unit XOR2 output value=0.

A third decision unit XOR, which includes an exclusive OR gate, compares the video data (l−4,q−1) of the (q−1)th cell on the (l−4)th line stored in the second buffer buf2 to the video data (l−4,q) of the qth cell on the (l−4)th line outputted from the first memory unit 901. If they are different from each other, the third decision unit XOR3 output value=1. If they are equal to each other, the third decision unit XOR3 output value=0.

A first decoder Dec1 receives, in parallel, a 1-bit output signal from each of the first, second and third decision units XOR1, XOR2 and XOR3. FIG. 13 is a table that contains all of the possible 3-bit patterns based on the output signals of the three decision units XOR1, XOR2, and XOR3. As stated, the table is included in the data comparison unit according to a first embodiment of the present invention. The table also provides the capacitance coefficient for each of the possible 3-bit patterns. It is the size of the capacitance, which is used in determining the size of the displacement current Id, varies according to the respective output signals Value1, Value2, and Value3 from each of the three of the decision units XOR1, XOR2, and XOR3.

Next, each of the first, second and third summation units Int1, Int2, and Int3 sums up an output count for the specific 3-bit output signal which is generated by the first decoder Dec1. Namely, the first summation unit Int1 sums up a count (C1) if the decoder Dec1 outputs one of the following 3-bit patterns: (0. 1. 0), (0, 1, 1), (1, 0, 0), and (1, 0, 1). The second summation unit Int2 sums up a count (C2) if the decoder Dec1 outputs (0, 0, 1). And, the third summation unit Int3 sums up a count (C3) if the decoder Dec1 outputs (1, 1, 1).

The first, second and third current calculating units Cal1, Cal2 and Cal3 receive C1, C2, and C3 from the first, second and third summation units Int1, Int2 and Int3 and compute displacement current for each of the three counts C1, C2 and C3, respectively. More specifically, the first current calculating unit Cal1 calculates displacement current by multiplying the output C1 of the first summation unit Int1 by (Cm1+Cm2). The second current calculating unit Cal2 calculates displacement current by multiplying the output C2 of the second summation unit Int2 by Cm2. And, the third current calculating unit Cal3 calculates displacement current by multiplying the output C3 of the third summation unit Int3 by (4Cm1+Cm2).

A first current summation unit Add1 then sums up the displacement currents calculated by the first, second and third current calculating units Cal1, Cal2 and to Cal3, respectively.

Like the operation of the first current determination unit 910, each of the second, third and fourth current determination units 930, 950, and 970 calculate displacement current in a similar manner. Thus, a first decision unit XOR1 in the second current determination unit 930 includes an exclusive OR gate that compares the video data (l,q) of the qth cell on the lth line to the video data (l,q−1) of the (q−1)th cell on the lth line stored in the first buffer buf1. If they are different from each other, the first decision unit XOR1 outputs 1. If they are equal to each other, the first decision unit XOR1 outputs 0.

A second decision unit XOR2 in the second current determination unit 930 includes an exclusive OR gate that compares the video data (l,q−1) of the (q−1)th cell on the lth line to the video data (l−3,q−1) of the (q−1)th cell on the (l−3)th line stored in the second buffer buf2. If they are different from each other, the second decision unit XOR2 outputs 1. If they are equal to each other, the second decision unit XOR2 outputs 0.

And, a third decision unit XOR3 in the second current determination unit 930 includes an exclusive OR gate that compares the video data (l−3,q−1) of the (q−1)th cell on the (l−3)th line stored in the second buffer buf2 to the video data (l−3,q) of the qth cell on the (l−3)th line outputted from the second memory unit 903. If they are different from each other, the third decision unit XOR3 outputs 1. If they are equal to each other, the third decision unit XOR3 outputs 0.

Likewise, a first decision unit XOR1 in the third current determination unit 950 includes an exclusive OR gate that compares the video data (l,q) of the qth cell on the lth line to the video data (l,q−1) of the (q−1)th cell on the lth line stored in the first buffer buf1. If they are different from each other, the first decision unit XOR1 outputs 1. If they are equal to each other, the first decision unit XOR1 outputs 0.

A second decision unit XOR2 in the third current determination unit 950 includes an exclusive OR gate that compares the video data (l,q−1) of the (q−1)th cell on the lth line to the video data (l−2,q−1) of the (q−1)th cell on the (l−2)th line stored in the second buffer buf2. If they are different from each other, the second decision unit XOR2 outputs 1. If they are equal to each other, the second decision unit XOR2 outputs 0.

A third decision unit XOR3 in the third current determination unit 950 includes an exclusive OR gate that compares the video data (l−2,q−1) of the (q−1)th cell on the (l−2)th line stored in the second buffer buf2 to the video data (l−2,q) of the qth cell on the (l−2)th line outputted from the third memory unit 905. If they are different from each other, the third decision unit XOR3 outputs 1. If they are equal to each other, the third decision unit XOR3 outputs 0.

Finally, a first decision unit XOR1 in the fourth current determination unit 970 includes an exclusive OR gate that compares the video data (l,q) of the qth cell on the lth line to the video data (l,q−1) of the (q−1)th cell on the lth line stored in the first buffer buf1. If they are different from each other, the first decision unit XOR1 outputs 1. If they are equal to each other, the first decision unit XOR1 outputs 0.

A second decision unit XOR2 in the fourth current determination unit 970 includes an exclusive OR gate that compares the video data (l,q−1) of the (q−1)th cell on the lth line to the video data (l−1,q−1) of the (q−1)th cell on the (l−1)th line stored in the second buffer buf2. If they are different from each other, the second decision unit XOR2 outputs 1. If they are equal to each other, the second decision unit XOR2 outputs 0.

A third decision unit XOR3 in the fourth current determination unit 970 includes an exclusive OR gate that compares the video data (l−1,q−1) of the (q−1)th cell on the (l−1)th line stored in the second buffer buf2 to the video data (l−1,q) of the qth cell on the (l−1)th line outputted from the fourth memory unit 907. If they are different from each other, the third decision unit XOR3 outputs 1. If they are equal to each other, the third decision unit XOR3 outputs 0.

The scan sequence decision unit 740 receives the displacement current calculations from the first through the fourth current determination units 910, 930, 950, and 970, respectively, and then decides which scan sequence is preferable based on the current determination unit that outputs the smallest displacement current calculation. Thus, if the scan sequence decision unit 740 determines that the displacement current calculation received from the second current determination unit 930 is the smallest, the scan sequence decision unit 740 will select the third scan type, Type 3, as illustrated in FIG. 7, which involves the following sequence: Y1-Y4-Y7 . . . , Y2-Y5-Y8 . . . , and Y3-Y6-Y9 . . . . If the scan sequence decision unit 740 determines that the displacement current received from the third current determination unit 950 is the smallest, the scan sequence decision unit 740 will select the second scan type, Type 2, as illustrated in FIG. 7, which involves the following sequence: Y1-Y3-Y5 . . . , Y2-Y4-Y6 . . . And, if the scan sequence decision unit 740 determines that the displacement current received from the fourth current determination unit 970 is the smallest, the scan sequence decision unit 740 will select the first scan type, Type 1, as illustrated in FIG. 7, which involves the following sequence: Y1-Y2-Y3-Y4-Y5-Y6 . . . , wherein the grouped scan lines are sequentially scanned.

In an alternative embodiment, the scan sequence decision unit 740 may decide which scan sequence is preferable based on a predefined threshold value. More specifically, the scan sequence decision unit 740 may compare each of the displacement currents Id, that it receives from the current determination units 910, 930, 950, and 970, and selects one scan sequence whose displacement current Id is less than the predefined threshold value.

Figure 14:
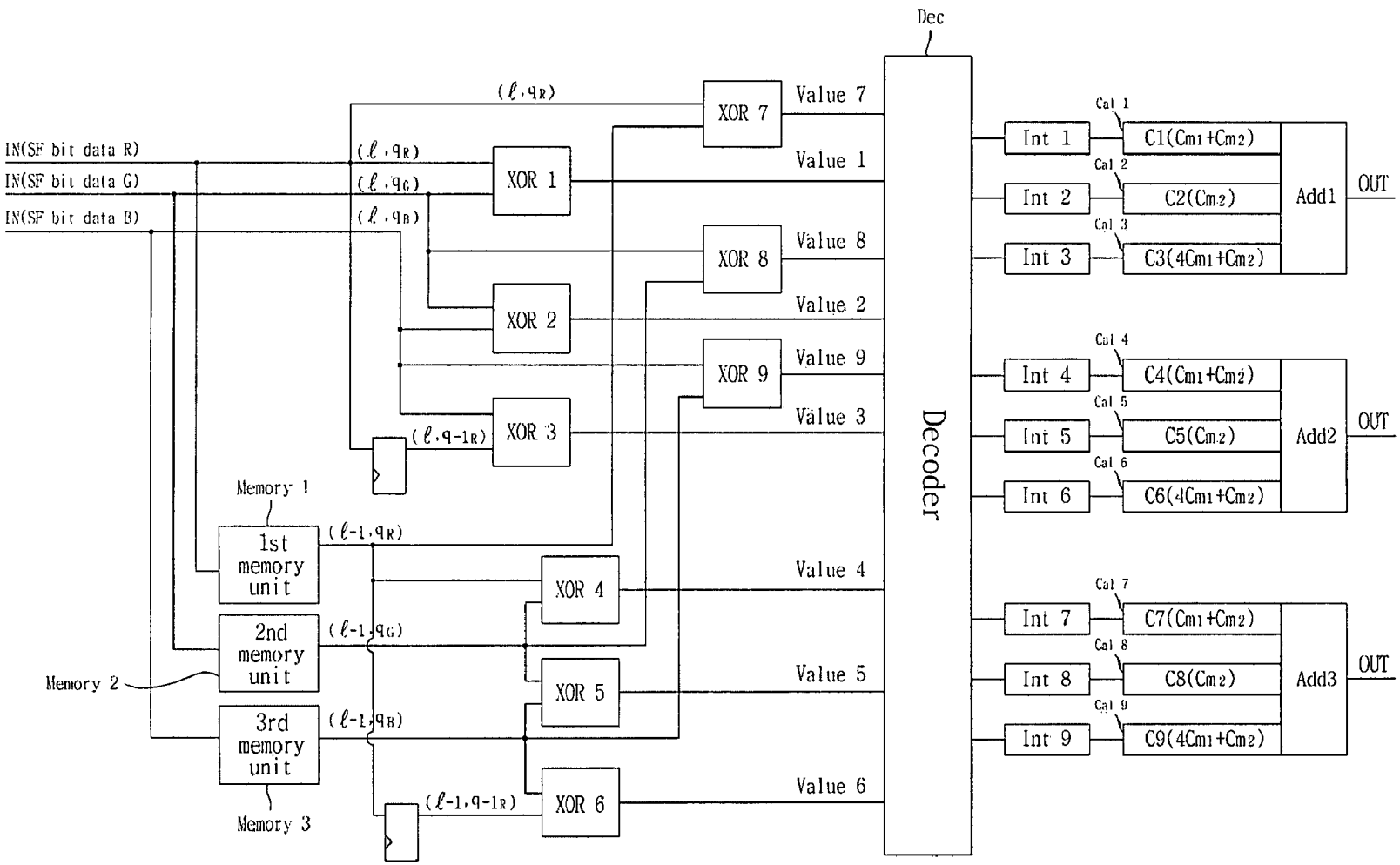
FIG. 14 is a block diagram of a basic circuit block included in a data comparison unit according to a second embodiment of the present invention.

FIG. 14 is a block diagram of a data comparison unit according to a second embodiment of the present invention. The data comparison unit calculates displacement current using a variation of video data corresponding to the R, G, and B subpixels of the qth pixel on the lth scan line, as well as the R subpixel of the (q−1) pixel on an lth scan line; a variation of video data corresponding to the R, G, and B subpixels of the qth pixel on the (l−1) scan line, as well as the R subpixel of the (q−1) pixel on an (l−1) scan line; and a variation of video data corresponding to the R, G, and B subpixels of a qth pixel on the lth scan line and the R, G, and B subpixels of the qth pixel on the (l−1) scan line.

We now turn to the components that make up the data comparison unit. The first, second and third memory units, Memory1, Memory 2 and Memory 3, temporarily store the video data corresponding to the R, G, and B subpixels on the (l−1)th line, respectively. The first, second and third decision units XOR1 to XOR 3 determine whether there is a variation between the video data corresponding to the R, G, and B subpixels of the qth pixel on the lth scan line, respectively. More specifically, the first decision unit XOR1 compares video data (l,qR) corresponding to the R subpixel of the qth pixel on the lth scan line to video data (l,qG) corresponding to the G subpixel of the qth pixel on the lth scan line. If they are equal to each other, the first decision unit XOR1 outputs a logic value 1. If they are different from each other, the first decision unit XOR1 outputs a logic value 0.

The second decision unit XOR2 compares the video data (l,qG) corresponding to the G subpixel of the qth pixel on the lth scan line to video data (l,qB) corresponding to the B subpixel of the qth pixel on the lth scan line. If they are equal to each other, the second decision unit XOR2 outputs a logic value 1. If they are different from each other, the second decision unit XOR2 outputs a logic value 0.

The third decision unit XOR3 compares the video data (l,qB) corresponding to the B subpixel of the qth pixel on the lth scan line to video data (l,q−1R) corresponding to the R subpixel of the (q−1)th pixel on the lth scan line. If they are equal to each other, the third decision unit XOR3 outputs a logic value 1. If they are different from each other, the third decision unit XOR3 outputs a logic value 0.

The fourth fifth and sixth decision units XOR4, XOR5 and XOR6 determine whether there is a variation between the video data corresponding to the R, G, and B subpixels of the qth pixel on the (l−1)th scan line. More specifically, the fourth decision unit XOR4 compares video data (l−1,qR) corresponding to the R subpixel of the qth pixel on the (l−1)th scan line to video data (l−1,qG) corresponding to the G subpixel of the qth pixel on the (l−1)th scan line. If they are equal to each other, the fourth decision unit XOR4 outputs a logic value 1. If they are different from each other, the fourth decision unit XOR4 outputs a logic value 0.

The fifth decision unit XOR5 compares the video data (l−1,qG) corresponding to the G subpixel of the qth pixel on the (l−1)th scan line to video data (l−1,qB) corresponding to the B subpixel of the qth pixel on the (l−1)th scan line. If they are equal to each other, the fifth decision unit XOR5 outputs a logic value 1. If they are different from each other, the fifth decision unit XOR5 outputs a logic value 0.

The sixth decision unit XOR6 compares the video data (l−1,qB) corresponding to the B subpixel of the qth pixel on the (l−1)th scan line to video data (l−1,q−1R) corresponding to the R subpixel of the (q−1)th pixel on the (l−1)th scan line. If they are equal to each other, the sixth decision unit XOR6 outputs a logic value 1. If they are different from each other, the sixth decision unit XOR6 outputs a logic value 0.

Moreover, the seventh, eighth and ninth decision units XOR7, XOR8 and XOR9 determines whether there is a variation in video data by comparing the video data corresponding to R, G, and B subpixels of the qth pixel on the lth scan line to the video data corresponding to R, G, and B subpixels of the qth pixel on the (l−1)th scan line, respectively. More specifically, the seventh decision unit XOR7 compares the video data (l,qR) corresponding to the R subpixel of the qth pixel on the lth scan line to video data (l−1,qR) corresponding to the R subpixel of the qth pixel on the (l−1)th scan line. If they are equal to each other, the seventh decision unit XOR7 outputs a logic value 1. If they are different from each other, the seventh decision unit XOR7 outputs a logic value 0.

The eighth decision unit XOR8 compares the video data (l,qG) corresponding to the G subpixel of the qth pixel on the lth scan line to video data (l−1,qG) corresponding to the G subpixel of the qth pixel on the (l−1)th scan line. If they are equal to each other, the eighth decision unit XOR8 outputs a logic value 1. If they are different from each other, the eighth decision unit XOR8 outputs a logic value 0.

The ninth decision unit XOR9 compares the video data (l,qB) corresponding to the B subpixel of the qth pixel on the lth scan line to video data (l−1,q−1B) corresponding to the B subpixel of the (q−1)th pixel on the (l−1)th scan line. If they are equal to each other, the ninth decision unit XOR9 outputs a logic value 1. If they are different from each other, the ninth decision unit XOR9 outputs a logic value 0.

A decoder Dec their outputs three 3-bit signals, where the first 3-bit signal corresponds to the output signals Value1 through value3 of decision units XOR1 through XOR3, the second 3-bit signal corresponds to output signals Value 4 through Value 6 of decision units XOR4 through XOR6, and the third 3-bit signal corresponds to output signals Value7 through Value9 of decision units XOR7 through XOR9, respectively.

FIG. 15 is a table containing all of the possible value combinations for the output signals of the first through ninth decision units XOR1 through XOR9 according to a second embodiment of the present invention.

Referring back to FIG. 14, the first through third summation units Int1 through Int3 sum up output counts C1, C2, and C3 based on the first the 3-bit signal corresponding to Value1, Value2 and Value3 of decision units XOR1, XOR2 and XOR3 from the decoder Dec, respectively. The fourth through sixth summation units Int4 through Int6 sum up output counts C4, C5, and C6 based on the second 3-bit signal corresponding to Value4, Value5 and Value6 of decision units XOR4, XOR5 and XOR6 from the decoder Dec, respectively. And, the seventh through ninth summation units Int7 to Int9 sum up output counts C7, C8, and C9 based on the third 3-bit signal corresponding to Value7, Value8 and Value9 of decision units XOR7, XOR8 and XOR9 from the decoder Dec, respectively.

Meanwhile, the first through third current calculating units Cal1 through Cal3 receive C1, C2, and C3 from the summation units Int1, Int2 and Int3, and therefrom, calculate the displacement current, respectively. The fourth through sixth current calculating units Cal4 to Cal6 receive C4, C5, and C6 from the summation units Int4, Int5 and Int6 and therefrom calculate displacement current, respectively. And, the seventh through ninth current calculating units Cal7 through Cal9 receive C7, C8, and C9 from the summation units Int7, Int8 and Int9 and therefrom calculate displacement current, respectively.

A first current summation unit Add1 then totals the displacement current calculation from the first through third current calculating units Cal1 through Cal3, respectively. A second current summation unit Add2 totals the displacement current calculations from the fourth through sixth current calculating units Cal4 to Cal6, respectively. And, a third current summation unit Add3 totals the displacement current calculations calculated by the seventh to ninth current calculating units Cal7 to Cal9, respectively. Thus, the displacement current is calculated based on the video data variations corresponding to the subpixels.

Figure 16:
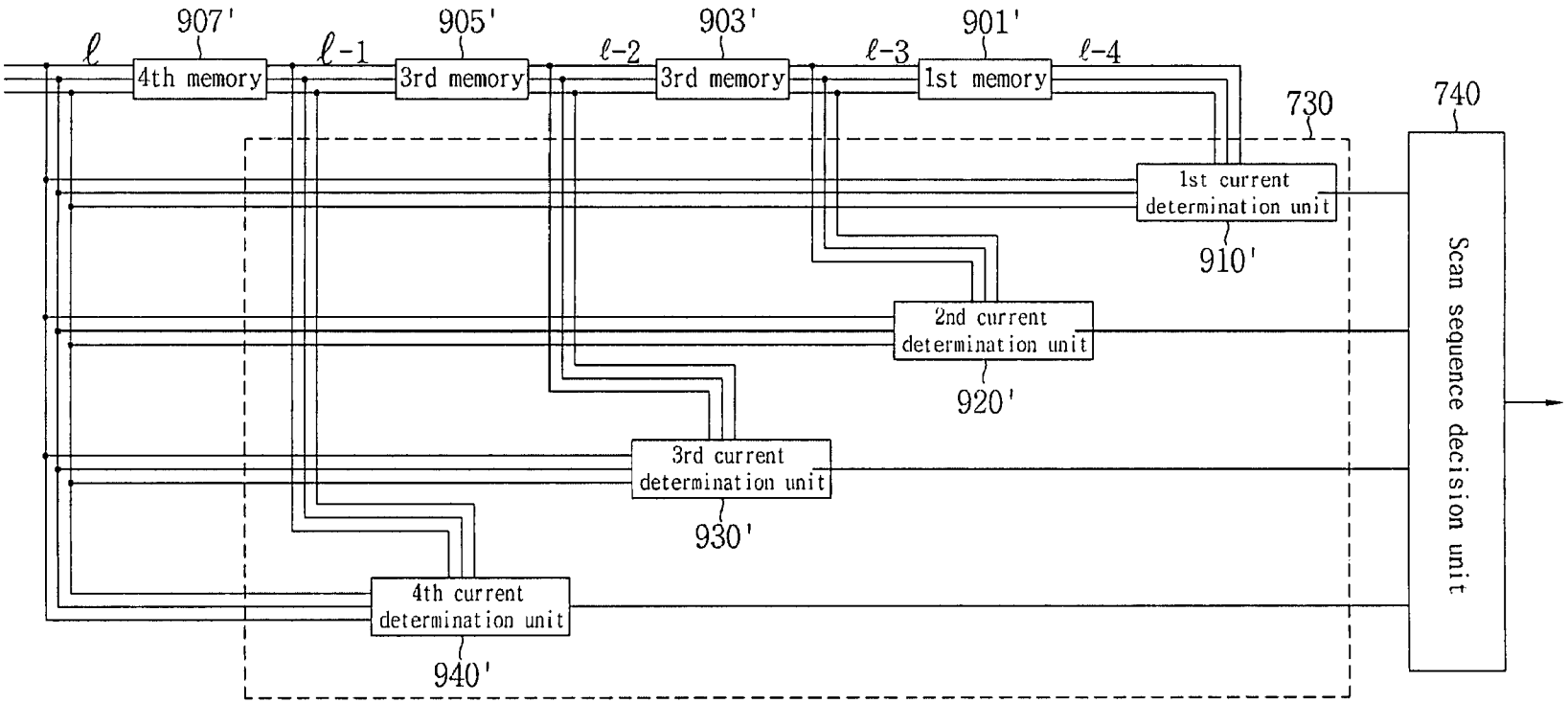
FIG. 16 is a block diagram of a data comparison unit and a scan sequence decision unit according to a second embodiment of the present invention.

FIG. 16 is a block diagram of a data comparison unit and a scan sequence decision unit 740 according to the second embodiment of the present invention. Referring to FIG. 16, the comparison unit 730 includes four basic circuit configurations, each of the four configurations is as shown in FIG. 14. That is, each of the four current determination units 910', 920', 930', and 940' in FIG. 16, have a configuration as shown in FIG. 14. The scan sequence decision unit 740 determines which one of four scan sequences is preferable, based on a determination as to which of the four currents determination units calculates the smallest displacement current.

To achieve this, the first current determination unit 910' compares video data (l,qR) to video data (l,qG), video data (l,qG) to video data (l,qB), video data (l,qB) to video data (l,q−1R), video data (l−4,qR) to video data (l−4,qG), video data (l−4,qG) to video data (l−4,qB), video data (l−4,qB) to video data (l−4,q−1R), video data (l,qR) to video data (l−4,qR), video data (l,qG) to video data (l−4,qG), and video data (l,qB) to video data (l−4,qB). In this case, 'l' and 'l−4' refer to the lth scan line and the (l−4)th scan line, respectively, and where 'qR', 'qG', and 'qB' refer to R, G, and B subpixels, respectively. And, 'q−1R', 'q−1G', and 'q−1B' refer to R, G, and B subpixels of the (q−1)th pixel, respectively. Hence, the first current determination unit 910' calculates displacement current corresponding to the Type 4 scan sequence by comparing the above-listed video data.

The second current determination unit 920' compares video data (l,qR) to video data (l,qG), video data (l,qG) to video data (l,qB), video data (l,qB) to video data (l,q−1R), video data (l−3,qR) to video data (l−3,qG), video data (l−3,qG) to video data (l−3,qB), video data (l−3,qB) to video data (l−3,q−1R), video data (l,qR) to video data (l−3,qR), video data (l,qG) to video data (l−3,qG), and video data (l,qB) to video data (l−3,qB). In this case, 'l' and 'l−3' refer to the lth scan line and the (l−3)th scan line, respectively. Hence, the second current determination unit 920' calculates displacement current corresponding to the Type 3 scan sequence by comparing the above-listed video data.

The third current determination unit 930' compares video data (l,qR) to video data (l,qG), video data (l,qG) to video data (l,qB), video data (l,qB) to video data (l,q−1R), video data (l−2,qR) to video data (l−2,qG), video data (l−2,qG) to video data (l−2,qB), video data (l−2,qB) to video data (l−2,q−1R), video data (l,qR) to video data (l−2,qR), video data (l,qG) to video data (l−2,qG), and video data (l,qB) to video data (l−2,qB). In this case, 'l' and 'l−2' refer to the lth scan line and the (l−2)th scan line, respectively. Hence, the third current determination unit 930' calculates displacement current corresponding to the Type 2 scan sequence by comparing the above-listed video data.

The fourth current determination unit 940' compares video data (l,qR) to video data (l,qG), video data (l,qG) to video data (l,qB), video data (l,qB) to video data (l,q−1R), video data (l−1,qR) to video data (l−1,qG), video data (l−1,qG) to video data (l−1,qB), video data (l−1,qB) to video data (l−1,q−1R), video data (l,qR) to video data (l−1,qR), video data (l,qG) to video data (l−1,qG), and video data (l,qB) to video data (l−1,qB). In this case, 'l' and 'l−1' refer to the lth scan line and the (l−1)th scan line, respectively. Hence, the fourth current determination unit 940' calculates displacement current corresponding to the Type 1 scan sequence by comparing the above-listed video data.

The scan sequence decision unit 740 receives the displacement current calculations from the first through fourth current determination units 910', 930', 950', and 970' and therefrom, determines the preferred scan sequence based on which of the four current determination units outputs the smallest displacement current value.

For instance, if the displacement current calculation received from the second current determination unit 930' is the smallest, the scan sequence decision unit 740 will determine that the third scan sequence, Type 3, is preferred where the scan sequence associated with Type 3 is as follows: Y1-Y4-Y7 . . . , Y2-Y5-Y8 . . . , and Y3-Y6-Y9 . . . , as illustrated in FIG. 7. If, instead, the displacement current calculation received from the third current determination unit 950' is the smallest, the scan sequence decision unit 740 will determine that the second scan sequence, Type 2, is preferred, where the Type 2 scan sequence is as follows: Y1-Y3-Y5 . . . and then Y2-Y4-Y6 . . . , as illustrated in FIG. 6.

Figure 17:
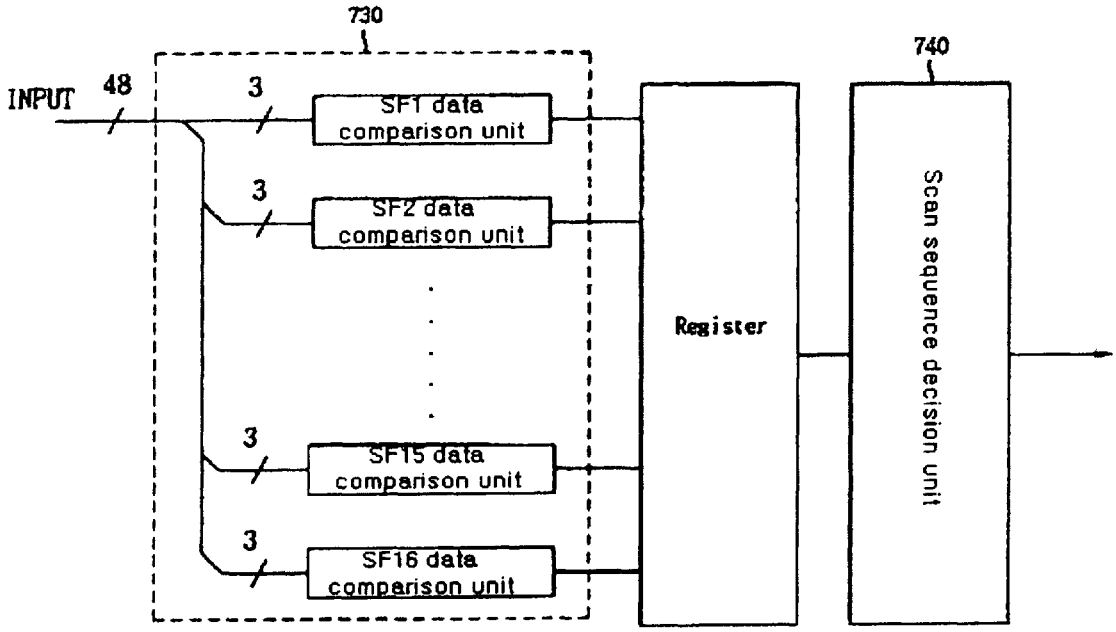
FIG. 17 is a block diagram of an embodiment that a data comparison unit and a scan sequence decision unit according to the present invention are applied to each subfield.

FIG. 17 is a block diagram illustrating an embodiment where a data comparison unit and a scan sequence decision unit according to the present invention are applied during each subfield. More particularly, each of sixteen data comparison units 730-SF1 through 730-SF16 calculates displacement current, according to the video pattern in the corresponding subfield, for each of a plurality of scan types, for example, scan Types 1, 2, 3 and 4. The data comparison unit then stores the displacement current calculations in a temporary storage unit 800. Each of the sixteen data comparison units 730-SF1 To 730-SF16 preferably has the same configuration as the data comparison unit shown in FIG. 12

The scan sequence decision unit 740 then compares the calculated displacement current for each video data patterns per subfield. The scan sequence decision unit 740 also recognizes the video data pattern that produces the smallest displacement current value. Based on this information, the scan sequence decision unit 740 then selects the preferred scan sequence for each subfield.

Thus, the drive apparatus and method for a PDP according to the exemplary embodiments of the present invention can be characterized in that they involve calculating displacement currents between scan lines for each of a plurality of scan types, and then sequentially scanning the lines in accordance with the preferred scan type which corresponds with the smallest displacement current. More specifically, by calculating the displacement currents between each of several scan line pairs, where the number of scan lines that separate the scan lines associated with each pair varies by a predetermined number of scan lines. Each pair represents a corresponding scan type. Thus, the pair that exhibits the smallest displacement current dictates which scan type should be used. Moreover, in the above description, the displacement current is calculated as a function of the following weights Cm2, Cm1+

Figure 1:
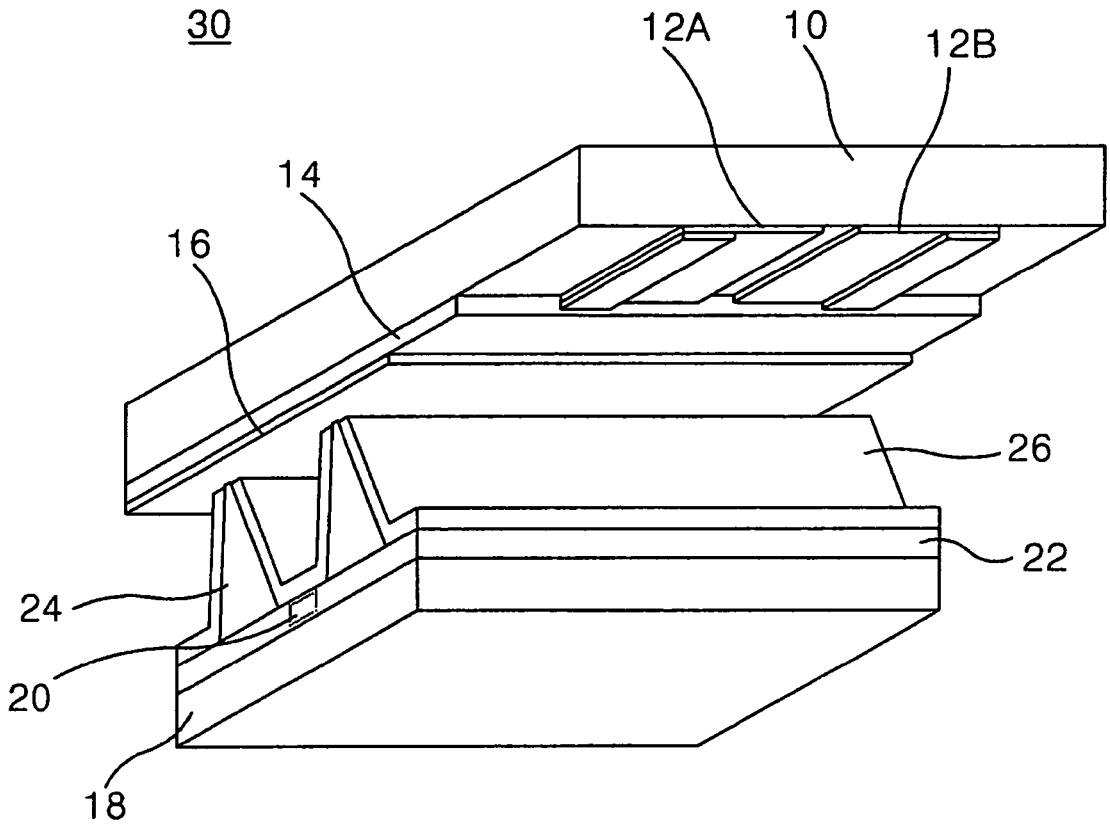
FIG. 1 is a perspective diagram of a PDP according to a related art.
Figure 2:
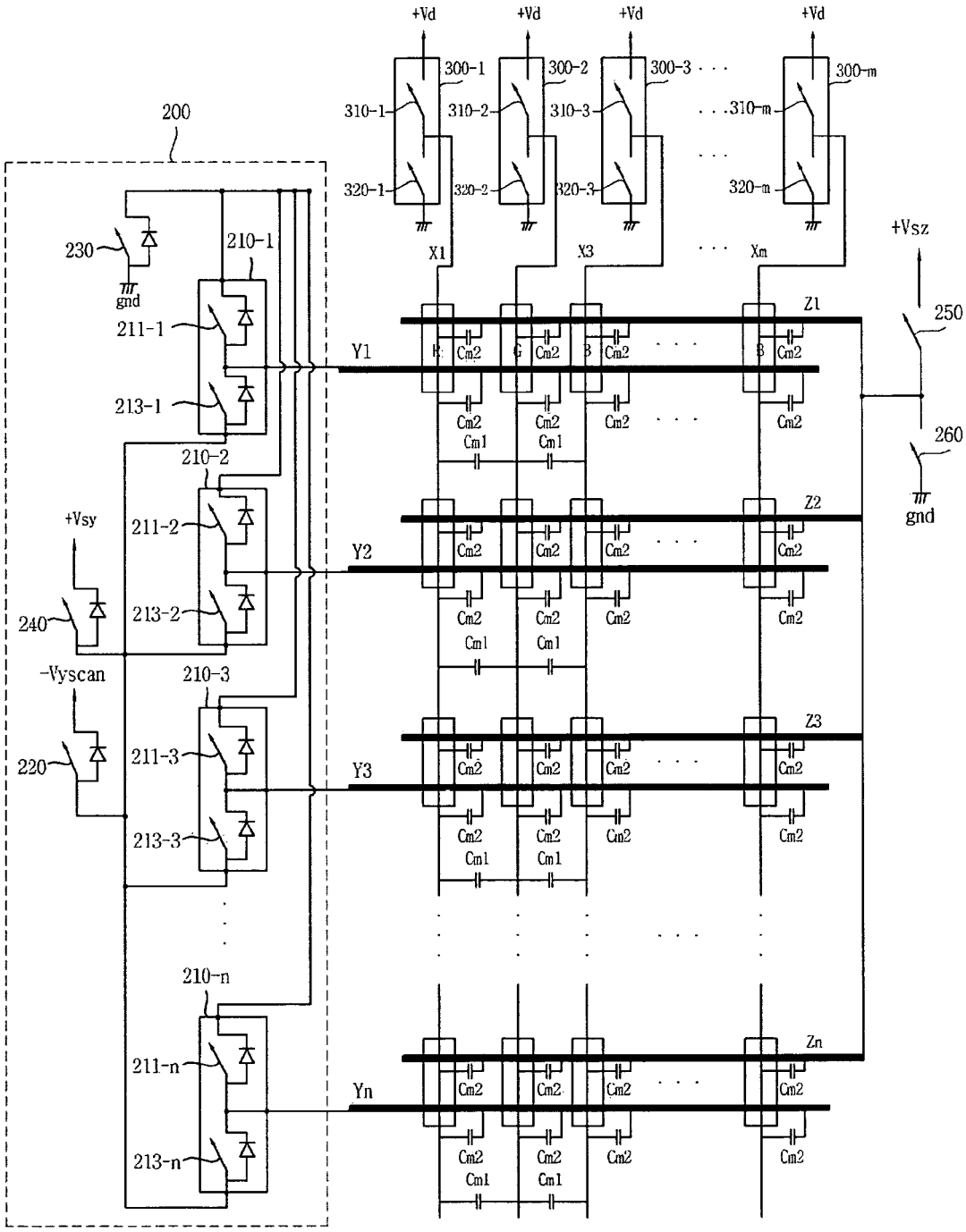
FIG. 2 is a circuit diagram of a drive device of a PDP according to a related art.

Cm2, or 4Cm1+Cm2, where Cm1 and Cm2 represent capacitance values for coupling capacitances as illustrated in FIG. 2. Alternatively, instead of using the weight, displacement current may be set to '0' in the case where displacement current does not flow or by setting the displacement current to '1' in the case where displacement current does flow. Thus, the displacement current for a given subfield is calculated by totaling the '0' or '1' values. For instance, in case of FIG. 9, the first through the third summation units 736-1 through 736-3 are reduced to one summation unit, while the current calculation units 737-1 to 737-3 and the current summation unit 738 can be omitted. In this case, the output counts of C1, C2, and C3 are counted by one summation unit and then the count value itself represents the displacement current for a given pattern.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus which includes a plurality of scan electrodes, a plurality of address electrodes crossing the scan electrodes, and a discharge cell where each of the address electrodes cross each of the scan electrodes, said apparatus comprising:

a scan sequencer for identifying one scan type from amongst a plurality of scan types based on displacement currents associated with each of the plurality of scan types;

a scan driver for scanning the plurality of scan electrodes according to a scanning pattern that corresponds with the one scan type;

a data driver for applying data signals to each of the plurality of address electrodes in accordance with the scanning pattern corresponding to the one scan type; and a displacement current calculator for calculating a displacement current for each of a plurality of scan types, based on displacement currents associated with one or more cells, wherein said scan sequencer is configured to identify one of the plurality of scan types where the displacement current corresponding to the one scan type is less than a displacement current predefined threshold.

2. The apparatus of claim 1, wherein the plurality of scan electrodes includes a first and a second scan electrode separated by a predetermined number of scan electrodes according to the one identified scan type, wherein the plurality of address electrodes includes a first and a second address electrode, and wherein the displacement current calculator is configured to calculate displacement current for a first discharge cell based on video data associated with the first cell, which is proximately located where the first scan electrode and the first address electrode cross, video data associated with a second discharge cell, which is proximately located where the first scan electrode and the second address electrode cross, video data associated with a third discharge cell, which is proximately located where the second electrode and the first address electrode cross, and video data associated with a fourth discharge cell, which is proximately located where the second scan electrode and the second address electrode cross.

3. The apparatus of claim 2, wherein the displacement current calculator is configured to derive a first result by comparing the video data of the first cell to the video data of the second cell, derive a second result by comparing the video data of the first cell to the video data of the third cell, derive a third result by comparing the video data of the third cell to the video data of the fourth cell, derive a displacement current corresponding to each of the first, second and third results, and then calculate a displacement current corresponding to the first discharge cell by totaling the displacement currents corresponding to the first, second and third results.

4. The apparatus of claim 3, wherein the displacement current calculator is configured to calculate the displacement currents corresponding to the first, second and third results based on Cm 1 and Cm2, wherein Cm 1 is the capacitance realized between adjacent data electrodes and wherein Cm2 is the capacitance realized between a data electrode and a scan electrode.

5. The apparatus of claim 3, wherein the displacement current calculator counts 1 for each of the first, second and third results if the corresponding comparison indicates there is displacement current flow, and the displacement current calculator counts a 0 for each of the first, second and third results if the corresponding comparison indicates there is no displacement current.

6. The apparatus of claim 3, wherein the displacement current calculator is configured to calculate a displacement current corresponding to each of a plurality of discharge cells during a given subfield, and to calculate a displacement current value for the subfield based on the displacement currents corresponding to each of the plurality of discharge cells.

7. The apparatus of claim 1, wherein the displacement current calculator is configured to calculate, for each subfield in a frame, a displacement current for each of the plurality of scan types, and wherein the scan sequencer is configured to establish the scanning pattern that corresponds with the one identified scan type having the smallest displacement current.

8. The apparatus of claim 1, wherein said scan sequencer is configured to compare the displacement currents associated with each of the different scan types.

9. The apparatus of claim 8, wherein said scan sequencer is configured to identify one of the plurality of scan types that exhibits the least amount of displacement current as compared to each of the remaining scan types.

10. The apparatus of claim 1, wherein the plurality of scan electrodes are divided into a plurality of groups according to the one identified scan type, and wherein the scan sequencer is configured to scan, in sequence, the scan electrodes belonging to a first group before scanning, in sequence, the scan electrodes belonging to a next group.

11. A plasma display apparatus which includes a plurality of scan electrodes, a plurality of address electrodes crossing the scan electrodes, and a cell proximately located where each of the scan electrodes cross each of the address electrodes, said apparatus comprising:

a displacement current calculator configured to calculate a displacement current, for one or more subfields in a frame, by calculating a displacement current value for each of a plurality of scan types;

a scan sequencer configured to identify a scan sequence corresponding to one of said plurality of scan types which has a smaller displacement current value as compared to the remaining scan types;

a scan driver configured to scan the scan electrodes according to the one identified scan sequence; and a data driver configured to apply a data signal to each of the plurality of address electrodes when the scan driver scans the scan electrodes.

12. The apparatus of claim 11, wherein the displacement current calculator is configured to calculate the displacement current value for each scan type based on a displacement current value associated with each of a plurality of cell sets, wherein each cell set comprises a plurality of cells.

13. The apparatus of claim 12, wherein the displacement current calculator is configured to calculate the displacement current value for a given cell set by calculating, in parallel, the displacement current value corresponding to each cell in the cell set.

14. The apparatus of claim 12, wherein each cell is a subpixel.

15. The apparatus of claim 14, wherein each cell set comprises a plurality of subpixels.

16. The apparatus of claim 15, wherein each cell set comprises 3 subpixels.

17. A plasma display apparatus comprising:

a scan electrode;

a data electrode crossing the scan electrode;

a scan driver configured for scanning the scan electrode according to a first one of a plurality of scan sequences, wherein each of the plurality of scan sequences is defined by a different electrode scanning order, and wherein a displacement current corresponding to the first one scan sequence is less than a displacement current predefined threshold; and a data driver configured for applying a data signal to the data electrode, wherein the data signal corresponds with the first one scan sequence.

18. The plasma display apparatus of claim 17 further comprising:

a discharge cell proximately located where the scan electrode and the data electrode cross.

19. The plasma display apparatus of claim 17, wherein each electrode scanning order defines a different number of scan electrodes between sequentially scanned scan electrodes.

20. A plasma display apparatus which includes a plurality of scan electrodes and a plurality of address electrodes crossing the scan electrodes, said apparatus comprising:

a scan driver configured to scan the plurality of scan electrodes in accordance with one of a plurality of scan sequences;

a data driver configured to apply a data signal to each of the plurality of address electrodes when the scan driver scans the plurality of scan electrodes in accordance with the one scan sequence; and a scan sequencer configured to select the one scan sequence from amongst the other scan sequences based on displacement current values corresponding to each of the scan sequences, wherein the one scan sequence has a displacement current value that is less than the displacement current values corresponding to the other scan sequences.

21. The plasma display apparatus of claim 20, wherein the one scan sequence has a displacement current value that is less than a displacement current predefined threshold.

22. The plasma display apparatus of claim 20, wherein the number of scan sequences is 3.

23. The plasma display apparatus of claim 20, wherein the number of scan sequences is 4.

24. A plasma display apparatus which includes a plurality of scan electrodes and a plurality of address electrodes crossing the scan electrodes, said apparatus comprising:

a scan driver configured to scan the plurality of scan electrodes in accordance with a plurality of can sequences including a first scan sequence, a second scan sequence and a third scan sequence;

a data driver configured to apply a data signal to each of the plurality of address electrodes when the scan driver scans the plurality of scan electrodes in accordance with the first scan sequence, the second scan sequence and the third scan sequence; and a scan sequencer configured to select one scan sequence from amongst the first, second and third scan sequences based on displacement current values corresponding to each of the first, second and third scan sequences, wherein the one scan sequence has a displacement current value that is less than the displacement current values corresponding to the other scan sequences.

25. The plasma display apparatus of claim 24, wherein the one scan sequence has a displacement current value that is less than a displacement current predefined threshold.

26. The plasma display apparatus of claim 24, wherein said scan driver is configured to scan the plurality of scan electrodes in accordance with a fourth scan sequence, and wherein said scan sequencer is configured to select the one scan sequence from amongst the first, second, third and fourth scan sequences based on displacement current values corresponding to each of the first, second, third and fourth scan sequences.

27. A plasma display apparatus comprising:

a plurality of scan electrodes;

a plurality of address electrodes crossing the scan electrodes;

a discharge cell where each of the address electrodes cross each of the scan electrodes;

means for identifying one scan type from amongst a plurality of scan types based on displacement currents associated with each of the plurality of scan types, wherein the displacement current corresponding to the one scan type is less than a displacement current predefined threshold;

means for scanning the plurality of scan electrodes according to a scanning pattern that corresponds with the one scan type; and means for applying data signals to each of the plurality of address electrodes in accordance with the scanning pattern corresponding to the one scan type.

28. The apparatus of claim 27 further comprising:

means for calculating a displacement current for each of the plurality of scan types, based on displacement currents associated with one or more cells.

29. The apparatus of claim 27, wherein said means for identifying one scan type comprises:

means for identifying one scan type from amongst the plurality of scan types, based on displacement currents associated with each of the plurality of scan types, for each of a plurality of subfields in a given frame.

30. A method of driving a plasma display apparatus which includes a plurality of scan electrodes, a plurality of address electrodes crossing the scan electrodes, and a discharge cell proximately located where each of the scan electrodes and each of the address electrodes cross, said method comprises the steps of:

scanning the plurality of scan electrodes in accordance with one of a plurality of scan sequences;

applying a data signal to each of the plurality of address electrodes when the scan driver scans the plurality of scan electrodes in accordance with the one scan sequence; and selecting the one scan sequence from amongst the other scan sequences based on displacement current values corresponding to each of the scan sequences, wherein the one scan sequence has a displacement current value that is less than the displacement current values corresponding to the other scan sequences.

31. A method of driving a plasma display apparatus which includes a plurality of scan electrodes, a plurality of address electrodes crossing the scan electrodes, and a discharge cell proximately located where each of the scan electrodes and each of the address electrodes cross, said method comprises the steps of:

scanning the plurality of scan electrodes in accordance with a selected scan sequence, wherein the selected scan sequence involves skipping some scan electrodes;

applying a data signal to each of the plurality of address electrodes when the scan driver scans the plurality of scan electrodes in accordance with the selected scan sequence; and selecting the scan sequence from amongst the other scan sequences based on displacement current values corresponding to each of the scan sequences, wherein the selected scan sequence has the displacement current value that is less than the displacement current values corresponding to the other scan sequences.

* * * * *